US011774053B2

(12) United States Patent
Chen et al.

(10) Patent No.: US 11,774,053 B2
(45) Date of Patent: Oct. 3, 2023

(54) LIGHT BOARD AND SPOTLIGHT

(71) Applicant: SHENZHEN SOONWELL TECHNOLOGY CO., LTD., SHENZHEN (CN)

(72) Inventors: Kai Chen, Shenzhen (CN); Zhangming Tan, Shenzhen (CN)

(73) Assignee: SHENZHEN SOONWELL TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/672,712

(22) Filed: Feb. 16, 2022

(65) Prior Publication Data

US 2023/0235865 A1 Jul. 27, 2023

(30) Foreign Application Priority Data

Jan. 24, 2022 (CN) ..... 202210081914.X

(51) Int. Cl.

| | |
|---|---|
| ***F21S 8/00*** | (2006.01) |
| ***F21V 29/83*** | (2015.01) |
| ***F21W 131/406*** | (2006.01) |
| ***F21Y 105/18*** | (2016.01) |
| ***F21Y 113/13*** | (2016.01) |
| ***F21Y 115/10*** | (2016.01) |

(52) U.S. Cl.

CPC ..... *F21S 8/00* (2013.01); *F21V 29/83* (2015.01); *F21W 2131/406* (2013.01); *F21Y 2105/18* (2016.08); *F21Y 2113/13* (2016.08); *F21Y 2115/10* (2016.08)

(58) Field of Classification Search

CPC ..... F21S 8/00; F21V 29/83; F21W 2131/406; F21Y 2105/00–18; F21Y 2113/10–20; F21Y 2115/10

See application file for complete search history.

(56) References Cited

U.S. PATENT DOCUMENTS

| | | | | |
|---|---|---|---|---|
| 9,416,948 | B2 * | 8/2016 | Nakamura | H01L 25/0753 |
| 9,877,370 | B2 * | 1/2018 | Peeters | H01L 25/0753 |
| 10,711,958 | B2 * | 7/2020 | Chung | H01L 33/50 |
| 2007/0268703 | A1 * | 11/2007 | Gasquet | F21V 17/16 362/294 |

* cited by examiner

*Primary Examiner* — Jason M Han

(57) ABSTRACT

The disclosure relates to a light board and a spotlight. The light board comprises a circuit board having multiple mounting positions, and lamp beads mounted in the mounting positions, which comprise multiple cool color lamp beads and multiple warm color lamp beads, the cool and warm color lamp beads are configured to form multiple lamp bead rows, which are arranged along a first direction. Each lamp bead row comprises both the cool and warm color lamp beads, a difference between the number of the cool and warm color lamp beads does not exceed 2, a difference between the number of the cool and warm color lamp beads in two adjacent lamp bead rows does not exceed 3, and a total number of cool color lamp beads is equal to that of warm color lamp beads. The technical solution of the disclosure is beneficial to improve lighting effects of lights.

3 Claims, 18 Drawing Sheets

LIGHT BOARD AND SPOTLIGHT

TECHNICAL FIELD

The present disclosure relates to a technical field of spotlights, and in particular to a light board and a spotlight.

RELATED ART

With the improvement of people's living standards, lights are no longer just illumination tools, they are widely used into all walks of life. For example, lights are used as supplementary lighting to improve photographic effects in shooting, photography, etc. However, it is difficult to meet the required photographic effect when an existing spotlight is used as a supplementary light, resulting in poor qualities of photos, which cannot meet users' requirements.

SUMMARY

The main purpose of the present disclosure is to provide a light board, which aims to improve the lighting effects emitted by lamps.

In order to achieve the above purpose, a light board is provided by the present disclosure. The light board comprises a circuit board and lamp beads. The circuit board has mounting positions. The lamp beads are mounted in the mounting positions and comprise cool color lamp beads and warm color lamp beads. The cool color lamp beads and the warm color lamp beads are configured to form lamp bead rows, and the lamp bead rows are arranged along a first direction. Each lamp bead row comprises both the cool color lamp beads and the warm color lamp beads. A difference between the number of the cool color lamp beads and that of the warm color lamp beads does not exceed 2. A difference between the total number of the cool color lamp beads and that of the warm color lamp beads in two adjacent lamp bead rows does not exceed 3. A total number of all the cool color lamp beads on the circuit board is equal to that of the warm color lamp beads.

Optionally, the light board has a display area. The display area comprises a first side luminous area, a second side luminous area, and a middle luminous area located between the first side luminous area and the second side luminous area. The first side luminous area comprises lamp bead rows. The number of lamp beads in each lamp bead row gradually increases from an edge to a middle portion of the display area. The second side luminous area comprises lamp bead rows, the number of lamp beads in each lamp bead row gradually increases from an edge to a middle portion of the display area.

Optionally, the number of the cool color lamp beads and the number of the warm color lamp beads in the first side luminous area are equal. The number of the cool color lamp beads and the number of the warm color lamp beads in the second side luminous area are equal. The total number of the lamp beads in the adjacent two lamp bead rows respectively in the first side luminous area and the middle luminous area are equal. The total number of the lamp beads in the adjacent two lamp bead rows respectively in the second side luminous area and the middle luminous area are equal.

Optionally, the middle luminous area comprises a first middle luminous subarea, a second middle luminous subarea, and a central luminous subarea located between the first middle luminous subarea and the second middle luminous subarea. The first middle luminous subarea is arranged adjacent to the first side luminous area, lamp bead rows are arranged within the first middle luminous subarea, and the number of lamp beads in the lamp bead rows gradually increases from near the first side luminous area to near the central luminous subarea. The second middle luminous subarea is arranged adjacent to the second side luminous area, lamp bead rows are arranged within the second middle luminous subarea, and the number of lamp beads in the lamp bead rows gradually increases from near the second side luminous area to near the central luminous subarea.

Optionally, the total numbers of the lamp beads in the adjacent two lamp bead rows respectively in the first middle luminous subarea and the central luminous subarea are equal. The total numbers of the lamp beads in the adjacent two lamp bead rows respectively in the second middle luminous subarea and the central luminous subarea are equal.

Optionally, the central luminous subarea comprises at least three lamp bead rows, and the number of the lamp beads in the lamp bead rows in the central luminous subarea gradually decreases from the middle to the first middle luminous subarea. The number of the lamp beads in the lamp bead rows in the central luminous subarea gradually decreases from the middle to the second middle luminous subarea.

Optionally, the number, the type and arrangement sequence of the lamp beads on a left edge of the first middle luminous subarea is equal to the number, the type and arrangement sequence of the lamp beads on a right edge of the second middle luminous subarea. The number of the lamp beads on a right edge of the first middle luminous subarea is equal to the number of the lamp beads on a left edge of the second middle luminous subarea, and the types of the lamp beads at each corresponding mounting position are different.

Optionally, a difference between the number of cool color lamp beads and the number of warm color lamp beads in each lamp bead row does not exceed 1. The number of the lamp bead rows is an odd row greater than 1, and there is at least one lamp bead row where the number of cool color lamp beads is equal to the number of warm color lamp beads. A difference between the numbers of total color lamp beads in two adjacent lamp bead rows does not exceed 4. The cool color lamp beads and the warm color lamp beads in each lamp bead row are arranged alternately.

Optionally, a color temperature of the cool color lamp beads is greater than or equal to 6000 Kelvin, and is less than or equal to 6500 Kelvin. A color temperature of the warm color lamp beads is greater than or equal to 2600 Kelvin, and is less than or equal to 3000 Kelvin. The mounting positions are arranged in a circular shape.

Optionally, each of the lamp beads comprises a bead body. A bottom of each bead body is provided with a first electrode welding position, a second electrode welding position, and a heat-conducting welding position. There are isolating gaps between any two of the first electrode welding position, the second electrode welding position, and the heat-conducting welding position. The circuit board is provided with the mounting positions for mounting the lamp beads. A positive electrode of the circuit board is electrically connected to the first electrode welding position, and a negative electrode of the circuit board is electrically connected to the second electrode welding position. The light board further comprises a heat-conducting substrate, which is welded to the heat-conducting welding position.

Optionally, the circuit board is provided with mounting holes. The positive and negative electrodes of the circuit board are located on a surface of the circuit board adjacent to the mounting holes. The heat-conducting substrate is welded with the heat-conducting welding position through the mounting holes, and the circuit board is located between the lamp beads and the heat-conducting substrate.

Optionally, the heat-conducting substrate comprises a substrate body and heat-conducting bosses arranged on the substrate body, and the heat-conducting bosses pass through the mounting holes to be welded to the heat-conducting welding positions.

Optionally, a horizontal section of the heat-conducting boss is any one of a circle, an ellipse, a square, and a triangle.

Optionally, an avoiding gap is configured between the adjacent two bosses, and a size of the avoiding gap is 1 mm to 3 mm.

Optionally, a horizontal sectional area of the heat-conducting boss is larger than respective areas of the first electrode welding position, the second electrode welding position, and the heat-conducting welding position.

Optionally, there are gaps between the heat-conducting bosses and the first and second electrode welding positions after the heat-conducting bosses are welded with the heat-conducting welding positions.

Optionally, a thickness of the substrate body is 1 mm to 3 mm, and/or a height of the heat-conducting boss is 0.15 mm to 1 mm.

Optionally, the circuit board is a flexible circuit board, which has a thickness of 0.15 mm to 1 mm.

Optionally, a thickness of the flexible circuit board is equal to the height of the heat-conducting boss.

Optionally, the circuit board has a top layer circuit and a bottom layer circuit, the top layer circuit comprises disconnected top layer circuit units. The bottom layer circuit comprises disconnected bottom layer circuit units. The top layer circuit comprises a positive electrode and a negative electrode, and there are connecting lines arranged in parallel between the positive electrode and the negative electrode. Any one of the connecting lines is used for connecting the lamp beads in the same type in lamp bead rows, and the connecting line is formed by connecting partial top layer circuit units and partial bottom layer circuit units in series.

Optionally, the top layer circuit unit is connected to mounting positions located in different lamp bead rows, and the lamp bead rows connected by the same top layer circuit unit are arranged adjacently in sequence. The bottom layer circuit unit is arranged in strip or block for connecting two different positions of the bottom layer circuit.

Optionally, each connecting line at least comprises two top layer circuit units and two bottom layer circuit units, and the connecting line is formed by alternately connecting the top layer circuit units and the bottom layer circuit units in series.

Optionally, there are positive electrodes and negative electrodes on the top layer circuit, and there are connecting lines arranged in parallel between each positive electrode and the corresponding negative electrode.

Optionally, the positive electrodes comprise a positive electrode A, a positive electrode C, a positive electrode E, and a positive electrode G. The negative electrodes comprise a negative electrode B, a negative electrode D, a negative electrode F, and a negative electrode H. The positive electrode A corresponds to the negative electrode B, the positive electrode C corresponds to the negative electrode D, the positive electrode E corresponds to the negative electrode F, and the positive electrode G corresponds to the negative electrode H.

Optionally, there are a first connecting line, a second connecting line, a third connecting line and a fourth connecting line arranged in parallel between the positive electrode A and the negative electrode B. The first connecting line is formed by: the positive electrode A is connected with a starting point B1 of a first bottom layer circuit unit B1-B2 through a connecting point A1, a connecting point B2 is connected with a starting point A3 of a first top layer circuit unit A3-A4, a connecting point A4 is connected with a starting point B3 of a second bottom layer circuit unit B3-B4, a connecting point B4 is connected with a starting point A5 of a second top layer circuit unit A5-A6, and a connecting point A6 is connected with the negative electrode B. The second connecting line is formed by: the positive electrode A is connected with the starting point B1 of the first bottom layer circuit unit B1-B2 through the connecting point A1, the connecting point B2 is connected with a starting point A8 of a third top layer circuit unit A8-A9, a connecting point A9 is connected with a starting point B5 of a third bottom layer circuit unit B5-B6, a connecting point B6 is connected with a starting point A10 of a fourth top layer circuit unit A10-A11, and a connecting point A11 is connected with the negative electrode B. The third connecting line is that: the positive electrode A is connected with the starting point B1 of the first bottom layer circuit unit B1-B2 through the connecting point A1, the connecting point B2 is connected with a starting point A12 of a fifth top layer circuit unit A12-A13, a connecting point A13 is connected with a starting point B7 of a fourth bottom layer circuit unit B7-B8, a connecting point B8 is connected with a starting point A14 of a sixth top layer circuit unit A14-A15, a connecting point A15 is connected with a starting point B9 of a fifth bottom layer circuit unit B9-B10, and a connecting point B10 is connected with the negative electrode B. The fourth connecting line is formed by: the positive electrode A is connected with the starting point B1 of the first bottom layer circuit unit B1-B2 through the connecting point A1, the connecting point B2 is connected with a starting point A16 of a seventh top layer circuit unit A16-A17, a connecting point A17 is connected with a starting point B11 of a sixth bottom layer circuit unit B11-B12, a connecting point B12 is connected with a starting point A18 of an eighth top layer circuit unit A18-A19, a connecting point A19 is connected with a starting point B13 of a seventh bottom layer circuit unit B13-B14, and a connecting point B14 is connected with the negative electrode B.

Optionally, there are a fifth connecting line, a sixth connecting line, a seventh connecting line and an eighth connecting line between the positive electrode C and the negative electrode D. The fifth connecting line is formed by: positive electrode C is connected with a starting point D1 of an eighth bottom layer circuit unit D1-D2, a connecting point D2 is connected with a starting point C2 of a ninth top layer circuit unit C2-C3, a connecting point C3 is connected with a starting point D3 of a ninth bottom layer circuit unit D3-D4, a connecting point D4 is connected with a starting point C4 of a tenth top layer circuit unit C4-C5, and a connecting point C5 is connected with the negative electrode D, The sixth connecting line is formed by: the positive electrode C is connected with the starting point D1 of the eighth bottom layer circuit unit D1-D2, the connecting point D2 is connected with a starting point C6 of an eleventh top layer circuit unit C6-C7, a connecting point C7 is connected with a starting point D5 of a tenth bottom layer circuit unit D5-D6, a connecting point D6 is connected with a starting point C8 of a twelfth top layer circuit unit C8-C9, and a connecting point C9 is connected with the negative electrode D. The seventh connecting line is formed by: the positive electrode C is connected with the starting point D1 of the eighth bottom layer circuit unit D1-D2, the connecting point D2 is connected with a starting point C10 of a thirteenth top layer circuit unit C10-C11, a connecting point C11 is connected with a starting point D7 of an eleventh bottom layer circuit unit D7-D8, a connecting point D8 is connected with a starting point C12 of a fourteenth top layer circuit unit C12-C13, a connecting point C13 is connected with a starting point D9 of a twelfth bottom layer circuit unit D9-D10, a connecting point D10 is connected with a starting point C15 of a fifteenth top layer circuit unit C15-C16, a connecting point C16 is connected with a starting point D11 of a thirteenth bottom layer circuit unit D11-D12, and a connecting point D12 is connected with the negative electrode D. The eighth connecting line is that: the positive electrode C is connected with the starting point D1 of the first bottom layer circuit unit D1-D2, the connecting point D2 is connected to the starting point C1 of a sixteenth top layer circuit unit C1-C17, a connecting point C17 is connected to a starting point D13 of a fourteenth bottom layer circuit unit D13-D14, a connecting point D14 is connected with a starting point C18 of an seventeenth top layer circuit unit C18-C19, and a connecting point C19 is connected with the negative electrode D.

Optionally, there are a ninth connecting line, a tenth connecting line, an eleventh connecting line and a twelfth connecting line between the positive electrode E and the negative electrode F. The ninth connecting line is formed by: the positive electrode E is connected with a starting point E1 of an eighteenth top layer circuit unit E1-E2, a connecting point E2 is connected with a starting point E3 of a nineteenth top layer circuit unit E3-E4, a connecting point E4 is connected with a starting point F1 of a fifteenth bottom layer circuit unit F1-F2, a connecting point F2 is connected with a starting point E5 of a twentieth top layer circuit unit E5-E6, a connecting point E6 is connected with a starting point F3 of a sixteenth bottom layer circuit unit F3-F4, and a connecting point F4 is connected with the negative electrode F. The tenth connecting line is formed by: the positive electrode E is connected with a starting point E7 of a twenty-first top layer circuit unit E7-E8, a connecting point E8 is connected with a starting point F5 of a seventeenth bottom layer circuit unit F5-F6, a connecting point F6 is connected with a starting point E9 of a twenty-second top layer circuit unit E9-E10, a connecting E10 is connected with the starting point F3 of the sixteenth bottom layer circuit unit F3-F4, and the connecting point F4 is connected with the negative electrode F. The eleventh connecting line is formed by: the positive electrode E is connected with a starting point E11 of a twenty-third top layer circuit unit E11-E12, a connecting point E12 is connected with a starting point F7 of an eighteenth bottom layer circuit unit F7-F8, a connecting point F8 is connected with a starting point E13 of a twenty-fourth top layer circuit unit E13-E14, a connecting point E14 is connected with the starting point F3 of the sixteenth bottom layer circuit unit F3-F4, and the connecting point F4 is connected with the negative electrode F. The twelfth connecting line is formed by: the positive electrode E is connected with a starting point E15 of a twenty-fifth top layer unit E15-E16, a connecting point E16 is connected with a starting point F9 of a nineteenth bottom layer circuit unit F9-F10, a connecting point F10 is connected with a starting point E17 of a twenty-sixth top layer circuit unit E17-E18, a connecting point E18 is connected to a starting point F11 of a twentieth bottom layer circuit unit F11-F4, and the connecting point F4 is connected with the negative electrode F.

Optionally, there are a thirteenth connecting line, a fourteenth connecting line, a fifteenth connecting line and a sixteenth connecting line between the positive electrode G and the negative electrode H. The thirteenth connecting line is formed by: the positive electrode G is connected with a starting point H1 of a twenty-first bottom layer circuit unit H1-H2, a connecting point H2 is connected with a starting point G1 of a twenty-seventh top layer circuit unit G1-G2, a connecting point G2 is connected with a starting point H3 of a twenty-second bottom layer circuit unit H3-H4, a connecting point H4 is connected with a starting point G3 of a twenty-eighth top layer circuit unit G3-G4, a connecting point G4 is connected with a starting point H5 of a twenty-third bottom layer circuit unit H5-H6, and a connecting point H6 is connected with a starting point G5 of an electrical connecting block G5-H. The fourteenth connecting line is formed by: the positive electrode G is connected with a starting point G6 of a twenty-ninth top layer circuit unit G6-G7, a connecting point G7 is connected with a starting point H7 of a twenty-fourth bottom layer circuit unit H7-H8, a connecting point H8 is connected with a starting point G8 of a thirtieth top layer circuit unit G8-G9, a connecting point G9 is connected with a starting point H5 of the twenty-third bottom layer circuit unit H5-H6, and the connecting point H6 is connected with the starting point G5 of the electrical connecting block G5-H. The fifteenth connecting line is that: the positive electrode G is connected with the starting point H1 of the twenty-first bottom layer circuit unit H1-H2, the connecting point H2 is connected with a starting point G11 of a thirty-first top layer circuit unit G11-G12, a connecting point G12 is connected with a starting point H9 of a twenty-fifth bottom layer circuit unit H9-H10, a connecting point H10 is connected with a starting point G13 of a thirty-second top layer circuit unit G13-G5, and the connecting point G5 is connected with the negative electrode H through the electrical connecting block G5-H. The sixteenth connecting line is that: the positive electrode G is connected with the starting point H1 of the twenty-first bottom layer circuit unit H1-H2, the connecting point H2 is connected with a starting point G10 of an electrical connecting block G10-G11, a connecting point G11 is connected with a starting point H11 of a twenty-sixth bottom layer circuit unit H11-H12, a connecting point H12 is connected with a starting point G15 of a thirty-third top layer circuit unit G15-G16, a connecting point G16 is connected with a starting point H13 of a twenty-seventh bottom layer circuit unit H13-H14, a connecting point H14 is connected with a starting point G17 of a thirty-fourth top layer circuit unit G17-G18, and a connecting point G18 is connected with the negative electrode H through an electrical connecting block G18-H.

The present disclosure further provides a spotlight, which comprises a light body and an electric control device. The light body comprises a light board. The light board comprises a circuit board having mounting positions and lamp beads mounted within the mounting positions, The lamp beads comprise cool color lamp beads and warm color lamp beads. The cool color lamp beads and the warm color lamp beads are configured to form lamp bead rows. The lamp beads are arranged in a first direction. Each lamp bead row comprises both the cool color lamp beads and the warm color lamp beads. A difference between the number of the cool color lamp beads and that of the warm color lamp beads does not exceed 2. A difference between the number of the cool color lamp beads and that of the warm color lamp beads in two adjacent lamp bead rows does not exceed 3. A total number of the cool color lamp beads is equal to that of the warm color lamp beads.

Optionally, the electric control device comprises an outer housing, a battery arranged within the first mounting chamber, and a main control board arranged within the second mounting chamber. The outer housing comprises a first mounting chamber, an air cooling passage, and a second mounting chamber. The air cooling passage is located between the first mounting chamber and the second mounting chamber. The first mounting chamber and the air cooling passage are separated by a first partition plate. The second mounting chamber and the air cooling passage are separated by a second partition plate. The outer housing is further provided with an air inlet and an air outlet communicating with the air cooling passage.

Optionally, the electric control device of the spotlight further comprises a heat-radiating rotor arranged at the air inlet.

Optionally, the electric control device of the spotlight further comprises a heat-radiating structure.

Optionally, the heat-radiating structure is configured as a heat-radiating rib, and the heat-radiating rib is connected to the second partition plate.

Optionally, the electric control device of the spotlight further comprises a first inner housing and a second inner housing that are arranged within the outer housing. The first inner housing encloses the first mounting chamber, the second inner housing encloses the second mounting chamber, and the air cooling passage is located between the first inner housing and the second inner housing. A housing plate of the first inner housing adjacent to the air cooling passage forms the first partition plate, and a housing plate of the second inner housing adjacent to the air cooling passage forms the second partition plate.

Optionally, a first connecting plate is protruded from the first partition plate towards the second partition plate, a second connecting plate is protruded from the second partition plate towards the first partition plate, and the first connecting plate is connected with the second connecting plate.

Optionally, a middle portion of the first connecting plate is bent to form a buckling groove. An end of the second connecting plate is bent to form a hook groove, and the hook groove and the buckling groove are engaged with each other.

Optionally, an end of the first connecting plate is lapped with the second connecting plate. The first connecting plate is provided with a through-hole. The second connecting plate is provided with a fixing hole corresponding to the through-hole. The through-hole and the fixing hole can be connected through a fastener.

Optionally, a heat-radiating hole is formed at the bottom of the second inner housing, and the heat-radiating hole is communicated with the air cooling passage.

Optionally, the electric control device of the spotlight further comprises an inner top cover. Openings are formed on the top of the first inner housing and the second inner housing, and the inner top cover is covered on the top of the first inner housing and the second inner housing. The inner top cover is provided with an air-passing hole, and the air-passing hole communicates the air inlet with the air cooling passage.

In the technical solution of the present disclosure, the cool color lamp beads and warm color lamp beads are configured to form lamp bead rows, and each lamp bead row comprises both the cool color lamp beads and the warm color lamp beads. A difference between the number of the cool color lamp beads and that of the warm color lamp beads does not exceed 2. A difference between the number of the cool color lamp beads and that of the warm color lamp beads in two adjacent lamp bead rows does not exceed 3. A total number of the cool color lamp beads is equal to that of the warm color lamp beads. When the light board is working, the cool color light emitted by the cool color lamp beads and the warm color light emitted by the warm color lamp beads can be fully mixed, thus the light emitted by the light board is highly close to natural light, which is beneficial to improve the effects of shooting, photography, video, and etc.

BRIEF DESCRIPTION OF THE DRAWINGS

In order to more clearly understand the technical solution hereinafter in embodiments of the present disclosure, a brief description to the drawings used in detailed description of embodiments hereinafter is provided thereof. Apparently, the drawings described below are some embodiments of the present disclosure, for those skilled in the art, other drawings can be obtained according to the drawings below without any creative work.

Figure 1:
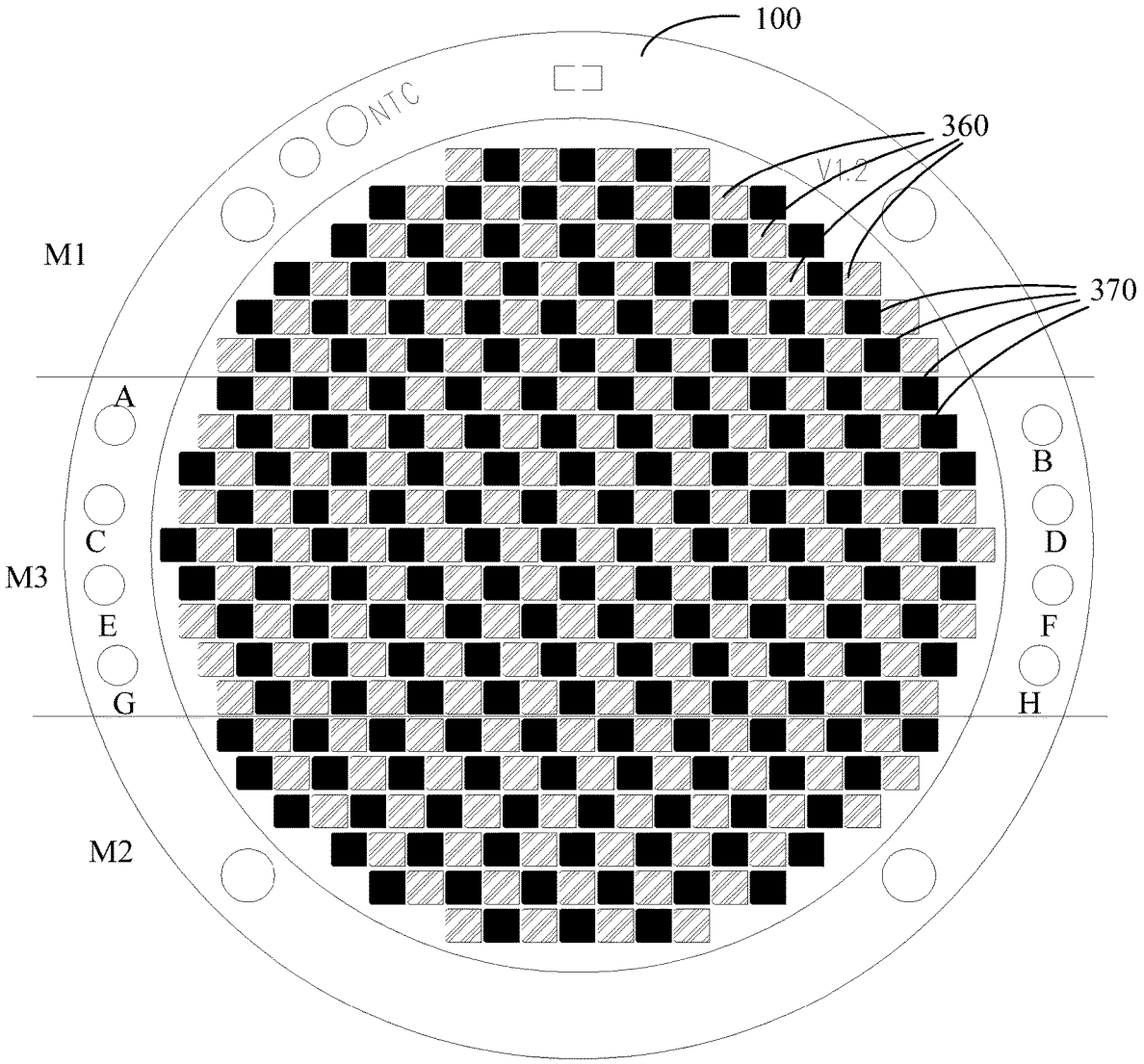
FIG. 1 is a schematic structural view of a light board according an embodiment of the present disclosure.

Reference numbers:

| Reference numbers | Name | Reference numbers | Name |
|---|---|---|---|
| 100 | circuit board | 360 | warm color lamp bead |
| 370 | cool color lamp bead | M1 | first side luminous area |
| M2 | second side luminous area | M3 | middle luminous area |
| M31 | first middle luminous subarea | M32 | second middle luminous subarea |
| M33 | central luminous subarea | M11 | first lamp bead row |
| M12 | second lamp bead row | M13 | third lamp bead row |
| M14 | fourth lamp bead row | M15 | fifth lamp bead row |
| M16 | sixth lamp bead row | M21 | seventh lamp bead row |
| M22 | eighth lamp bead row | M23 | ninth lamp bead row |
| M24 | tenth lamp bead row | M25 | eleventh lamp bead row |
| M26 | twelfth lamp bead row | M311 | thirteenth lamp bead row |
| M312 | fourteenth lamp bead row | M313 | fifteenth lamp bead row |
| M321 | sixteenth lamp bead row | M322 | seventeenth lamp bead row |
| M323 | eighteenth lamp bead row | M331 | nineteenth lamp bead row |
| M332 | twentieth lamp bead row | M333 | twenty-first lamp bead row |
| 110 | mounting hole | 200 | heat-conducting substrate |
| 210 | substrate body | 220 | heat-conducting boss |
| 300 | lamp beads | 310 | bead body |
| 325 | isolating gap | 320 | first electrode welding position |
| 330 | second electrode welding position | 350 | heat-conducting welding position |
| 120 | top layer circuit | 130 | bottom layer circuit |

-continued

Reference numbers:

| Reference numbers | Name | Reference numbers | Name |
|---|---|---|---|
| 150 | mounting positions | 160 | top layer circuit unit |
| 170 | bottom layer circuit unit | 181 | first connecting line |
| 182 | second connecting line | 183 | third connecting line |
| 184 | fourth connecting line | 185 | fifth connecting line |
| 186 | sixth connecting line | 187 | seventh connecting line |
| 188 | eight connecting line | 189 | ninth connecting line |
| 190 | tenth connecting line | 191 | eleventh connecting line |
| 192 | twelfth connecting line | 193 | thirteenth connecting line |
| 194 | fourteenth connecting line | 195 | fifteenth connecting line |
| 196 | sixteenth connecting line | 400 | outer housing |
| 410 | first mounting chamber | 420 | second mounting chamber |
| 430 | air cooling passage | 510 | first partition plate |
| 520 | second partition plate | 440 | air inlet |
| 450 | air outlet | 530 | battery |
| 550 | main control board | 560 | heat-radiating rotor |
| 570 | heat-radiating structure | 580 | first inner housing |
| 590 | second inner housing | 610 | first connecting plate |
| 620 | second connection plate | 611 | through-hole |
| 621 | fixing hole | 630 | heat-radiating hole |
| 700 | inner top cover | 710 | air-passing hole |

The realization, functional features and advantages of the present disclosure will be further described with reference to the accompanying drawings in combination with the embodiments.

Preferred Embodiments of the Present Disclosure

The technical solutions in the embodiments of the present disclosure will be clearly and completely described in conjunction with the accompanying drawings hereafter. Apparently, the described embodiments are part of the embodiments of the present disclosure, rather than all of the embodiments. All other embodiments obtained by those skilled in the art based on the embodiments of the present disclosure without creative efforts shall fall within the protection scope of the present disclosure.

It should be noted that all directional indications (such as up, down, left, right, front, back, etc.) in the embodiments of the present disclosure are merely used for explaining relative relationships, motion, etc. among various components under a certain posture (as shown in the accompanying drawings). If the specific posture changes, the directional indications also change accordingly.

In addition, the descriptions involving "first", "second", etc. in the present disclosure are barely for descriptive purposes, but not to be interpreted as indicating or implying relative importance or implicitly indicating the amount of indicated technical features. Thus, a feature defined by "first", "second" may expressly or implicitly include at least one of that feature. Besides, "and/or" in the full specification includes three solutions, taking A and/or B as an example, including a technical solution A, a technical solution B, and a technical solution that A and B satisfy at the same time. In addition, the technical solutions among various embodiments can be combined mutually, but must be based on the realization by those skilled in the art. When the combination of technical solutions is contradictory or cannot be realized, it should be interpreted that the combination of technical solutions does not exist and not within the protection scope claimed by the present disclosure.

The present disclosure mainly provides a light board, which is mainly used in a spotlight for illumination or used for supplementary lighting during shooting, photography, or video. Apparently, it can also be used to form lighting effects in some specific conditions. In the light board provided by the present disclosure, cool color lamp beads and warm color lamp beads are arranged alternately, and the number of the cool color lamp beads is the same as that of the warm color lamp beads, so that the light board can produce soft and uniform lighting that is close to natural light.

Figure 2:
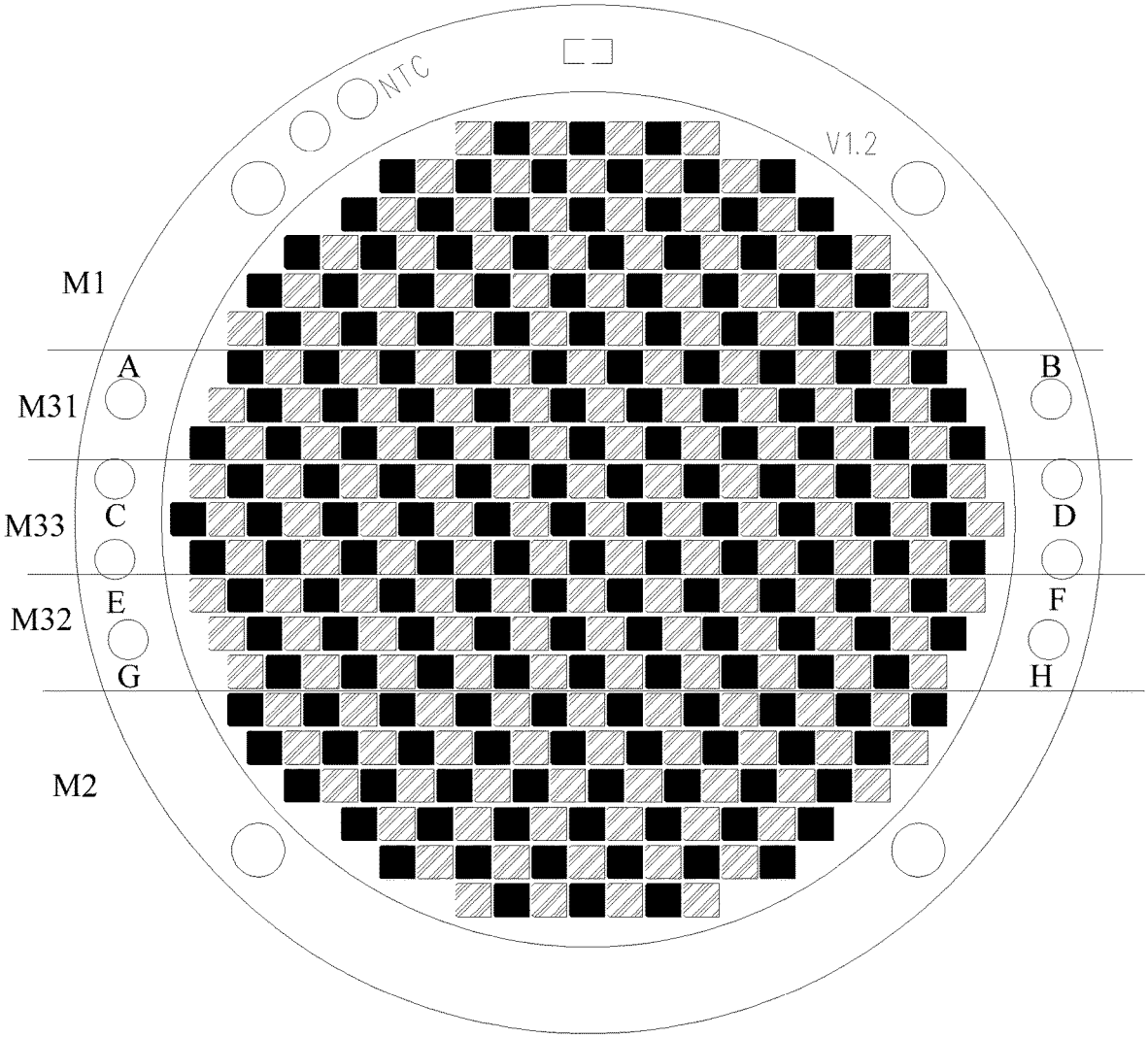
FIG. 2 is a schematic structural view of the light board according another embodiment of the present disclosure.
Figure 3:
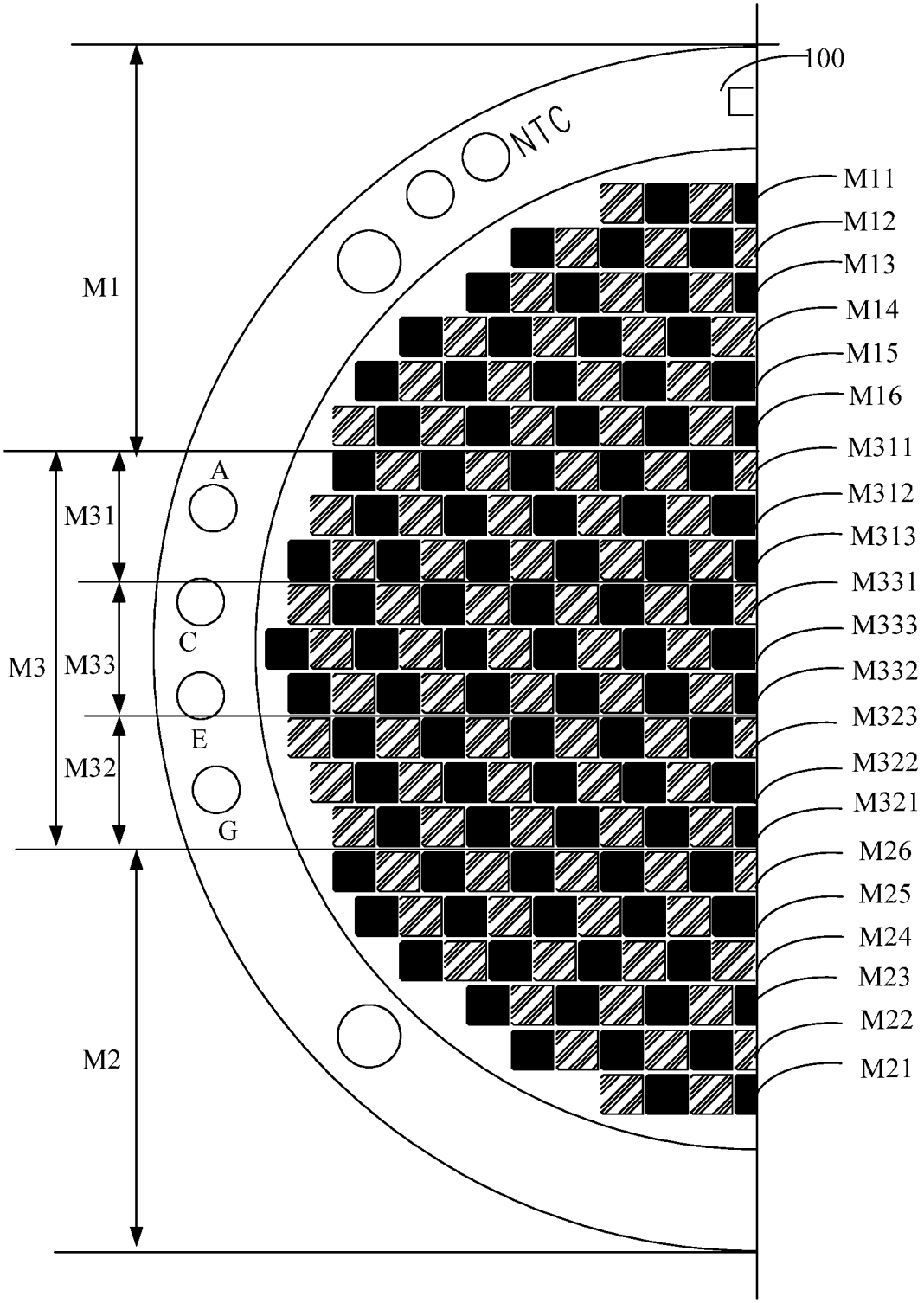
FIG. 3 is partial schematic structural view in FIG. 2.

The specific structure of the light board will be mainly described hereafter. Referring to FIG. 1 to FIG. 3, in an embodiment of the present disclosure, the light board comprises: a circuit board 100 and lamp beads. The circuit board 100 has a plurality of mounting positions. The amp beads are arranged in the mounting positions and comprise cool color lamp beads 370 and warm color lamp beads 360. The cool color lamp beads 370 and the warm color lamp beads 360 are configured to form lamp bead rows, and the lamp bead rows are arranged along a first direction. Each lamp bead row comprises both the cool color lamp beads 370 and the warm color lamp beads 360, and a difference between the number of the cool color lamp beads 370 and that of the warm color lamp beads 360 does not exceed 2. A difference between the total number of the cool color lamp beads 370 and that of the warm color lamp beads 360 in two adjacent lamp bead rows does not exceed 3. A total number of the cool color lamp beads 370 on the circuit board 100 is equal to that of the warm color lamp beads 360.

Specifically, in this embodiment, the circuit board 100 is provided with a positive electrode and a negative electrode. The positive electrode and the negative electrode are electrically connected to a power supply source through wires or circuits, so that the circuit board 100 is electrically connected to the power supply source. The circuit board 100 can be a printed circuit board 100 or a flexible circuit board 100, etc., which is not specifically limited herein, as long as it can be used as a medium for mounting each cool color lamp bead 370 and each warm color lamp bead 360 and can be used to electrically connect with the power supply source. For example, when the circuit board 100 is the printed circuit board 100, each cool color lamp bead 370 and each warm color lamp bead 360 are mounted on the same side of the circuit board 100 and electrically connected to the circuit board 100. In this case, when a power cord is connected to the power supply source, the warm color lamp beads 360 and the cool color lamp beads 370 are electrically connected to the power supply source through the circuit board 100.

The circuit board 100 is provided with mounting positions, and the mounting positions can be positions for mounting the lamp beads, or can also be mounting slots, mounting holes or mounting marks for mounting the lamp beads. The circuit board 100 may have different shapes, such as square, circle, ellipse, or other regular or irregular shapes, which are not particularly limited herein. The plurality of mounting positions may be arranged in different shapes, taking a shape consistent with the circuit board 100 as an example, in this embodiment, the plurality of mounting positions are arranged in a circle for instance.

The lamp beads could have different forms, and LED lamp beads are taken as an example. In this embodiment, in order to further improve the mixing effect of the cool-warm colors when the light board is working, a color temperature of the cool color lamp beads 370 is greater than or equal to 6000 Kelvin and less than or equal to 6500 Kelvin, and/or a color temperature of the warm color lamp beads 360 is greater than or equal to 2600 Kelvin and less than or equal to 3000 Kelvin. The color temperature of the cool color lamp beads 370 is taken as an example of 6000 Kelvin, which corresponds to a white light, and the color temperature of the warm color lamp beads 360 is taken as an example of 2600 Kelvin, which corresponds to a light-yellow light and close to a traditional gas light. Taking a circle light board as an example, the first direction may be the diameter direction of the light board. Apparently, in other embodiments, the first direction can also be other directions. The light board has a display area, which is provided with lamp bead rows for emitting light. The number of lamp bead rows can be different depending on different display areas of the light board, and can also be arranged differently according to different working conditions. In this embodiment, each lamp bead row comprises both the cool color lamp beads 370 and the warm color lamp beads 360, and the difference between the number of the cool color lamp beads 370 and that of the warm color lamp beads 360 does not exceed 2.That is, the number of the cool color lamp beads 370 in each lamp bead row will not be three more than that of the warm color lamp beads 360, or will not be three less than that of the warm color lamp beads 360. In some embodiments, in order to further improve the mixing degree of the cool light and warm light, the difference between the number of the cool color lamp beads 370 and that of the warm color lamp beads 360 in each lamp bead row is not more than 1, that is, in each lamp bead row, the number of the cool color lamp beads 370 is equal to that of the warm color lamp beads 360, or the number of the cool color lamp beads 370 is one more than that of the warm color lamp beads 360, or the number of the cool color lamp beads 370 is one less than that of the warm color lamp beads 360.

In some embodiments, the lamp bead rows at different positions is required to have different numbers of the lamp beads to meet a shape of a display area. In this embodiment, the number of the lamp bead rows is an odd numbered row that is greater than 1, and the number of cool color lamp beads 370 and the number of warm color lamp beads 360 are equal in at least one lamp bead row. That is, the number of lamp bead rows in this embodiment may be 3, 5, 7, 9, 11, 13, 15, 17, 19, 21, 23, etc., the present disclosure takes 21 lamp bead rows as an example. In some embodiments, in order to further improve a mixing degree of cool color light and warm color light, a difference between the numbers of color lamp beads in each lamp bead row and the number of the color lamp beads in the adjacent lamp bead row does not exceed 4, that is, the difference between the numbers of total color lamp beads in adjacent two lamp bead rows cannot be too large, thereby avoiding uneven mixing. Apparently, in some embodiments, the cool color lamp beads 370 and the warm color lamp beads 360 in each lamp bead row may be alternately arranged, that is, in the same lamp bead row, there must be one cool color lamp bead 370 arranged between any two adjacent warm color lamp beads 360, and there must be one warm color lamp bead 360 arranged between any two adjacent cool color lamp beads 370.

In the present embodiment, a plurality of cool color lamp beads 370 and warm color lamp beads 360 are arranged to form a plurality of lamp bead rows, and each lamp bead row comprises both cool color lamp beads 370 and warm color lamp beads 360. A difference between the number of cool color lamp beads 370 and the number of warm color lamp beads 360 does not exceed 2, and a difference between the total number of cool color lamp beads 370 and the total number of warm color lamp beads 360 in two adjacent lamp bead rows does not exceed 3, and a total number of all the cool color lamp beads 370 on the circuit board 100 is equal to that of warm color lamp beads 360. When the light board is working, the cool color light emitted by the cool color lamp beads 370 and the warm color light emitted by the warm color lamp beads 360 can be fully mixed, thus the light emitted by the light board is highly close to natural light, which is beneficial to improve the effects of shooting, photography, video, and etc.

In some embodiments, in order to further improve the lighting effect, the light board has a display area. The display area comprises a first side luminous area M1, a second side luminous area M2, and a middle luminous area M3 located between the first side luminous area M1 and the second side luminous area M2. The first side luminous area M1 comprises lamp bead rows, the number of lamp beads in each lamp bead row gradually increases from an edge to a middle portion of the display area, and/or, the second side luminous area M2 comprises lamp bead rows, the number of lamp beads in each lamp bead row gradually increases from an edge to a middle portion of the display area.

Specifically, in this embodiment, the display area may have different shapes such as square shape, circular shape, elliptical shape, etc. In this embodiment, a circular shape is taken as an example. The first side luminous area M1, the middle luminous area M3, and the second luminous area M2 are sequentially arranged along a diameter direction of the display area.

The first side luminous area M1 comprises lamp bead rows, and the number of the lamp bead rows thereof can be configured according to different situations, such as 3 to 12 rows. In this embodiment, for example, six lamp bead rows are arranged within the first side luminous area M1, and the six lamp bead rows are respectively a first lamp bead row M11 to a sixth lamp bead row M16 in sequence. The lamp bead row is arranged closer to a middle portion of the display area, the number of the lamp beads contained in the lamp bead row is more. An incremental form thereof can be an equal difference increase, or can be increased in other forms, such as the number of the lamp beads in the first lamp bead row M11 at the edge is 7, the number of the lamp beads in the second lamp bead row M12 adjacent to the first lamp bead row M11 can be 8, 9, 10, 11 or 12; and 11 is now taken as the example of the number of lamp beads in the second lamp bead row M12. The number of the lamp beads in the third lamp bead row M13 adjacent to the second lamp bead row M12 can be 12 to 15, and 13 is now taken as an example. The number of the lamp beads in the fourth lamp bead row M14 adjacent to the third lamp bead row M13 can be 14 to 18, and 16 is now taken as an example. The number of the lamp beads in the fifth lamp bead row M15 adjacent to the fourth lamp bead row M14 can be 17-20, and 18 is now taken as an example. The number of the lamp beads in the sixth lamp bead row M16 adjacent to the fifth lamp bead row M15 can be 19 to 22, and 19 is now taken as an example.

The second side luminous area M2 comprises lamp bead rows, and the number of the lamp bead rows thereof can be configured according to different situations, such as 3 to 12 rows. In this embodiment, for example, six lamp bead rows are arranged within the second side luminous area M2, and the six lamp bead rows are respectively a seventh lamp bead row M21 to a twelfth lamp bead row M26 in sequence. The lamp bead row is arranged closer to a middle portion of the display area, the number of the lamp beads contained in the lamp bead row is more. An incremental form thereof can be an equal difference increase, or can be increased in other forms, such as the number of the lamp beads in the seventh lamp bead row M21 at the edge is 7, the number of the lamp beads in the eighth lamp bead row M22 adjacent to the seventh lamp bead row M21 can be 8, 9, 10, 11 or 12; and 11 is now taken as an example of the number of lamp beads in the eighth lamp bead row M22. The number of the lamp beads in the ninth lamp bead row M23 adjacent to the eighth lamp bead row M22 can be 12 to 15, and 13 is now taken as an example. The number of the lamp beads in the tenth lamp bead row M24 adjacent to the ninth lamp bead row M23 can be 14 to 18, and 16 is now taken as an example. The number of the lamp beads in the eleventh lamp bead row M25 adjacent to the tenth lamp bead row M24 can be 17-20, and 18 is now taken as an example. The number of the lamp beads in the twelfth lamp bead row M26 adjacent to the eleventh lamp bead row M25 can be 19 to 22, and 19 is now taken as an example.

In this embodiment, the number of the lamp beads in each lamp bead row of the first side luminous area M1 and that of the second side luminous area M2 are configured as gradually increase from the edge to the middle of the display area, so that the range of the luminous area is gradually increased while ensuring the mixing effects of the cool light and warm light, by this way, the light emitted from both sides of the display area is more in line with the light requirements of shooting, photography and video.

In some embodiments, in order to further improve the light mixing effect of the first side luminous area M1 and the second side luminous area M2, the number of the cool color lamp beads 370 and that of the warm color lamp beads 360 in the first side luminous area M1 are equal; and/or, the number of the cool color lamp beads 370 and that of the warm color lamp beads 360 in the second side luminous area M2 are equal; and/or, the total numbers of the lamp beads in the adjacent two lamp bead rows respectively in the first side luminous area M1 and the middle luminous area M3 are equal; and/or, the total numbers of the lamp beads in the adjacent two lamp bead rows respectively in the second side luminous area M2 and the middle luminous area M3 are equal. The total number of the lamp beads in the last row of the first side luminous area M1 is equal to the total number of the lamp beads in the first row of the middle luminous area M3; the total number of the lamp beads in the first row of the second side luminous area M2 is equal to the total number of lamp beads in the last row of the middle luminous area M3. Referring to FIG. 3, the number of lamp beads in the sixth lamp bead row M16 is equal to the number of lamp beads in the thirteenth lamp bead row M311, and the number of lamp beads in the twelfth lamp bead row M26 is equal to the number of lamp beads in the sixteenth lamp bead row M321.

Specifically, in this embodiment, the number of the cool color lamp beads 370 and that of the warm color lamp beads 360 in the first side luminous area M1 are configured as equal, so that the light mixing effect in the first side luminous area M1 is better, thus to fully ensure the light mixing effect of the first side luminous area M1. Similarly, the number of the cool color lamp beads 370 and that of the warm color lamp beads 360 in the second side luminous area M2 are configured as equal, so that the light mixing effect in the second side luminous area M2 is better, thus to fully ensure the light mixing effect of the second side luminous area M2.

The total numbers of the lamp beads in the adjacent two lamp bead rows respectively in the first side luminous area M1 and the middle luminous area M3 are configured as equal, so that the light intensity of the first side luminous area M1 and that of the central luminous subarea M3 at the adjacent position are the same, and the first side luminous area M1 can transit to the middle luminous area M3 smoothly, thus the light mixing effect is better. Similarly, the total numbers of the lamp beads in the adjacent two lamp bead rows respectively in the second side luminous area M2 and the middle luminous area M3 are configured as equal, so that the light intensity of the second side luminous area M2 and that of the central luminous subarea M3 at the adjacent position are the same, and the second side luminous area M2 can transit to the middle luminous area M3 smoothly, thus the light mixing effect is better.

In some embodiments, in order to further improve the light mixing effect of the middle luminous area M3, the middle luminous area M3 comprises a first middle luminous subarea M31, a second middle luminous subarea M32, and a central luminous subarea M33 located between the first middle luminous subarea M31 and the second middle luminous subarea M32. The first middle luminous subarea M31 is arranged adjacent to the first side luminous area M1, lamp bead rows are arranged within the first middle luminous subarea M31, and the number of the lamp beads in the lamp bead rows gradually increases from near the first side luminous area M1 to near the central luminous subarea M33; and/or, the second middle luminous subarea M32 is arranged adjacent to the second side luminous area M2, lamp bead rows are arranged within the second middle luminous subarea M32, and the number of the lamp beads in the lamp bead rows gradually increases from near the second side luminous area M2 to near the central luminous subarea M33.

Specifically, in this embodiment, the number of the lamp bead rows contained in the first middle luminous subarea M31 may be different such as 2 to 5 rows, taking 3 rows as an example, and the lamp bead rows thereof are a thirteenth lamp bead row M311 to a fifteenth lamp bead row M313 in sequence, respectively. The thirteenth lamp bead row M311 is arranged adjacent to the sixth lamp bead row M16, and the number of the lamp beads in the thirteenth lamp bead row M311 is equal to the number of the lamp beads in the sixth lamp bead row M16. The number of the lamp beads in the lamp bead rows in the first middle luminous subarea M31 is configured as gradually increases from near the first side light luminous area M1 to near the central luminous subarea M33, so that the irradiation range of the first middle luminous subarea M31 gradually increases from the first side luminous area M1 to the middle portion. The number of the lamp beads in the thirteenth lamp bead row M311 can be 19 to 22, and 19 is now taken as an example. The number of the lamp beads in the fourteenth lamp bead row M312 adjacent to the thirteenth lamp bead row M311 can be 20 to 23, and 20 is now taken as an example. The number of the lamp beads in the fifteenth lamp bead row M313 adjacent to the fourteenth lamp bead row M312 can be 21 to 24, and 21 is now taken as an example.

The number of the lamp bead rows contained in the second middle luminous subarea M32 may be different such as 2 to 5 rows, taking 3 rows as an example, and the lamp bead rows thereof are a sixteenth lamp bead row M321 to an eighteenth lamp bead row M323 in sequence, respectively. The sixteenth lamp bead row M321 is arranged adjacent to the twelfth lamp bead row M26, and the number of the lamp beads in the sixteenth lamp bead row M321 is equal to the number of the lamp beads in the twelfth lamp bead row M26. The number of the lamp beads in the lamp bead rows in the second middle luminous subarea M32 is configured as gradually increases from near the second side light luminous area M2 to near the central luminous subarea M33, so that the irradiation range of the second middle luminous subarea M32 gradually increases from the second side luminous area M2 to the middle portion. The number of the lamp beads in the sixteenth lamp bead row M321 can be 19 to 22, and 19 is now taken as an example. The number of the lamp beads in the seventeenth lamp bead row M322 adjacent to the sixteenth lamp bead row M321 can be 20 to 23, and 20 is now taken as an example. The number of the lamp beads in the eighteenth lamp bead row M323 adjacent to the seventeenth lamp bead row M322 can be 21 to 24, and 21 is now taken as an example.

In some embodiments, in order to further improve the light-emitting effect, the total numbers of the lamp beads in the adjacent two lamp bead rows respectively in the first middle luminous subarea M31 and the central luminous subarea M33 are equal. The total numbers of the lamp beads in the adjacent two lamp bead rows respectively in the second middle luminous subarea M32 and the central luminous subarea M33 are equal.

Specifically, in this embodiment, the total numbers of the lamp beads in the adjacent two lamp bead rows respectively in the first middle luminous subarea M31 and the central luminous subarea M33 are configured as equal, so that the light intensity of the first middle luminous subarea M31 and that of the central luminous subarea M33 at the adjacent position are the same, and the first middle luminous subarea M31 can transit to the central luminous subarea M33 smoothly, thus the light mixing effect is better. Similarly, the total numbers of the lamp beads in the adjacent two lamp bead rows respectively in the second middle luminous subarea M32 and the central luminous subarea M33 are configured as equal, so that the light intensity of the second middle luminous subarea M32 and that of the central luminous subarea M33 at the adjacent position are the same, and the second middle luminous subarea M32 can transit to the central luminous subarea M33 smoothly, thus the light mixing effect is better.

In some embodiments, in order to further improve the light mixing effect, a central luminous subarea M33 comprises at least three lamp bead rows, the number of the lamp beads in the lamp bead rows in the central luminous subarea M33 gradually decreases from the middle to the first middle luminous subarea M31. The number of the lamp beads in the lamp bead rows in the central luminous subarea M33 gradually decreases from the middle to the second middle luminous subarea M32.

Specifically, in this embodiment, the number of lamp bead rows contained in the central luminous subarea M33 may be different such as 3 to 5 rows, taking 3 rows as an example, and the lamp bead rows thereof are a nineteenth lamp bead row M331 to a twenty-first lamp bead row M333 in sequence, respectively. The nineteenth lamp bead row M331 is arranged adjacent to the fifteenth lamp bead row M313, and the number of the lamp beads in the nineteenth lamp bead row M331 is equal to the number of the lamp beads in the fifteenth lamp bead row M313. The twentieth lamp bead row M332 is arranged adjacent to the eighteenth lamp bead row M323, and the number of lamp beads in the twentieth lamp bead row M332 is equal to the number of lamp beads in the eighteenth lamp bead row M323. The twenty-first lamp bead row M333 is located in a central position and its number of the lamp beads can be 20 to 22, taking 20 as an example.

In addition, a ratio of the number of the lamp bead rows in the central luminous subarea M33 to that of the lamp bead rows in the first middle luminous subarea M31 and that of lamp bead rows in the first side luminous area M1 is 1:1:2, and a ratio of the number of the lamp bead rows in the central luminous subarea M33 to that of the lamp bead rows in the second middle luminous subarea M32 and that of lamp bead rows in the second side luminous area M2 is 1:1:2. In this case, the light intensity of the entire display area is very uniform, which is beneficial to improve the light mixing effect.

In some embodiments, in order to better improve the light mixing effect, the number of the lamp beads on a left edge of the first middle luminous subarea M31 is equal to the number of the lamp beads on a right edge of the second middle luminous subarea M32, and the types of the lamp beads at the corresponding positions are different. The number of the lamp beads on a right edge of the first middle luminous subarea M31 is equal to the number of the lamp beads on a left edge of the second middle luminous subarea M32, and the types of the lamp beads at the corresponding positions are different.

Specifically, in this embodiment, the number of the lamp beads on the left edge of the first middle luminous subarea M31 can be different, such as 3 lamp beads (the first middle luminous subarea M31 has 3 lamp bead rows). There can be many combination types of the 3 lamp beads, such as 3 warm color lamp beads 360, 3 cool color lamp beads 370, 2 warm color lamp beads 360 and 1 cool color lamp bead 370, or 1 warm color lamp bead 360 and 2 cool color lamp beads 370. There can be many arrangement sequences, taking 2 cool color lamp beads 370 and 1 warm color lamp bead 360 as an example for description. In a direction from near the first side luminous area M1 to near the central luminous subarea M33, the types of the 3 lamp beads can sequentially be warm color, cool color, warm color; or warm color, warm color, cool color; or cool color, warm color, warm color, taking cool color, warm color, cool color as an example.

Similarly, the number of the lamp beads on the right edge of the second middle luminous subarea M32 can be different, such as 3 lamp beads (the second middle luminous subarea M32 has 3 lamp bead rows). There can be many combination types of the 3 lamp beads, such as 3 warm color lamp beads 360, 3 cool color lamp beads 370, 2 warm color lamp beads 360 and 1 cool color lamp bead 370, or 1 warm color lamp bead 360 and 2 cool color lamp beads 370. There can be many arrangement sequences, taking 1 cool color lamp bead 370 and 2 warm color lamp beads 360 as an example for description. In a direction from near the second side luminous area M2 to near the central luminous subarea M33, the types of the 3 lamp beads can sequentially be: warm color, cool color, warm color; or warm color, warm color, cool color; or cool color, warm color, warm color, taking warm color, cool color, warm color as an example.

Similarly, the number of the lamp beads on the right edge of the first middle luminous subarea M31 can be different, such as 3 lamp beads (the first middle luminous subarea M31 has 3 lamp bead rows). There can be many combination types of the 3 lamp beads, such as 3 warm color lamp beads 360, 3 cool color lamp beads 370, 2 warm color lamp beads 360 and 1 cool color lamp bead 370, or 1 warm color lamp bead 360 and 2 cool color lamp beads 370, taking 3 cool color lamp beads 370 as an example.

Similarly, the number of the lamp beads on the left edge of the second middle luminous subarea M32 can be different, such as 3 lamp beads (the second middle luminous subarea M32 has 3 lamp bead rows). There can be many combination types of the 3 lamp beads, such as 3 warm color lamp beads 360, 3 cool color lamp beads 370, 2 warm color lamp beads 360 and 1 cool color lamp bead 370, or 1 warm color lamp bead 360 and 2 cool color lamp beads 370, taking 3 warm color lamp beads 360 as an example.

By configuring the lamp bead types on the left and right edges of the first middle luminous subarea M31 and the left and right edges of the second middle luminous subarea M32 respectively, the light mixing effect of the cool light and the warm light is better. It is worth noting that, the numbers of the lamp beads in the lamp bead rows respectively in the first middle luminous subarea M31 and the second middle luminous subarea M32 are equal when they are in the same distance to the central luminous subarea M33. When the cool color lamp beads 370 and the warm color lamp beads 360 in the lamp bead row are alternately arranged, there is an axial symmetry between the entire left side of the first middle luminous subarea M31 and the entire right side of the second middle luminous subarea M32, so that the lamp bead types in the corresponding positions are different. Similarly, there is an axial symmetry between the entire right side of the first middle luminous subarea M31 and the entire left side of the second middle luminous subarea M32, so that the lamp bead types in the corresponding positions are different.

Regarding the quantities and arrangement orders of the cool color lamp beads 370 and the warm color lamp beads 360 in each lamp bead row, there can be many directions, and a specific example is given below for illustration. Taking the light board with 21 lamp bead rows as an example, the types of the cool color lamp beads 370 and the warm color lamp beads 360 can all be switched.

Table 1 is an arrangement table of the lamp beads.

| Area | lamp bead row | quantity of lamp beads | lamp beads arrangement |
|---|---|---|---|
| first side luminous area M1 | first lamp bead row M11 | 7 | warm, cool, warm, cool, warm, cool, warm |
| | second lamp bead row M12 | 11 | cool, warm, cool, warm, cool, warm, cool, warm, cool, warm, cool |
| | third lamp bead row M13 | 13 | cool, warm, cool, warm, cool, warm, cool, warm, cool, warm, cool, warm, cool |
| | fourth lamp bead row M14 | 16 | cool, warm, cool, warm, cool, warm, cool, warm, cool, warm, cool, warm, cool, warm, cool, warm |
| | fifth lamp bead row M15 | 18 | cool, warm, cool, warm, cool, warm, cool, warm, cool, warm, cool, warm, cool, warm, cool, warm, cool, warm |
| | sixth lamp bead row M16 | 19 | warm, cool, warm, cool, warm, cool, warm, cool, warm, cool, warm, cool, warm, cool, warm, cool, warm, cool, warm |

-continued

Table 1 is an arrangement table of the lamp beads.

| Area | | lamp bead row | quantity of lamp beads | lamp beads arrangement |
|---|---|---|---|---|
| second side luminous area M2 | | seventh lamp bead row M21 | 7 | warm, cool, warm, cool, warm, cool, warm |
| | | eighth lamp bead row M22 | 11 | cool, warm, cool, warm, cool, warm, cool, warm, cool, warm, cool |
| | | ninth lamp bead row M23 | 13 | cool, warm, cool, warm, cool, warm, cool, warm, cool, warm, cool, warm, cool |
| | | tenth lamp bead row M24 | 16 | cool, warm, cool, warm, cool, warm, cool, warm, cool, warm, cool, warm, cool, warm, cool, warm |
| | | eleventh lamp bead row M25 | 18 | cool, warm, cool, warm, cool, warm, cool, warm, cool, warm, cool, warm, cool, warm, cool, warm |
| | | twelfth lamp bead row M26 | 19 | cool, warm, cool, warm, cool, warm, cool, warm, cool, warm, cool, warm, cool, warm, cool, warm, cool |
| middle luminous area M3 | first middle luminous subarea M31 | thirteenth lamp bead row M311 | 19 | cool, warm, cool, warm, cool, warm, cool, warm, cool, warm, cool, warm, cool, warm, cool, warm, cool |
| | | fourteenth lamp bead row M312 | 20 | warm, cool, warm, cool, warm, cool, warm, cool, warm, cool, warm, cool, warm, cool, warm, cool, warm, cool |
| | | fifteenth lamp bead row M313 | 21 | cool, warm, cool, warm, cool, warm, cool, warm, cool, warm, cool, warm, cool, warm, cool, warm, cool, warm, cool |
| | second middle luminous subarea M32 | sixteenth lamp bead row M321 | 19 | warm, cool, warm, cool, warm, cool, warm, cool, warm, cool, warm, cool, warm, cool, warm, cool, warm |
| | | seventeenth lamp bead row M322 | 20 | warm, cool, warm, cool, warm, cool, warm, cool, warm, cool, warm, cool, warm, cool, warm, cool, warm, cool |
| | | eighteenth lamp bead row M323 | 21 | warm, cool, warm, cool, warm, cool, warm, cool, warm, cool, warm, cool, warm, cool, warm, cool, warm, cool, warm |
| | central luminous subarea M33 | nineteenth lamp bead row M331 | 21 | warm, cool, warm, cool, warm, cool, warm, cool, warm, cool, warm, cool, warm, cool, warm, cool, warm, cool, warm |
| | | twentieth lamp bead row M332 | 21 | cool, warm, cool, warm, cool, warm, cool, warm, cool, warm, cool, warm, cool, warm, cool, warm, cool, warm, cool |
| | | twenty-first lamp bead row M333 | 22 | cool, warm, cool, warm, cool, warm, cool, warm, cool, warm, cool, warm, cool, warm, cool, warm, cool, warm, cool, warm |

Figure 4:
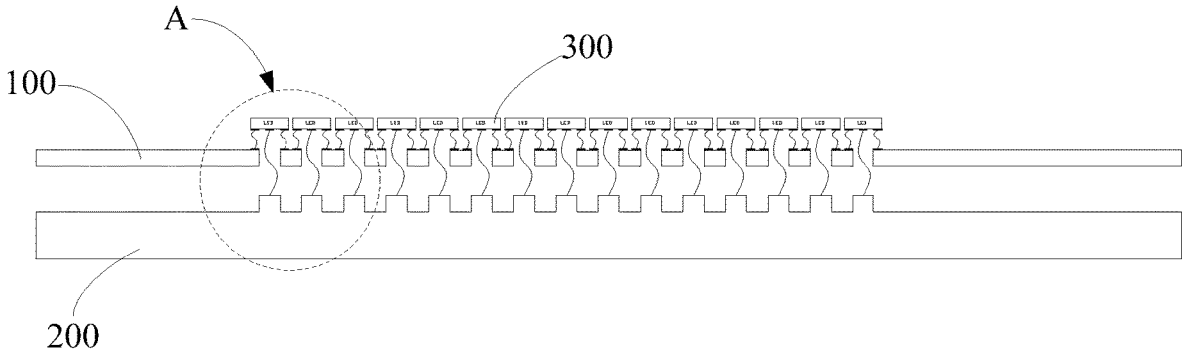
FIG. 4 is a longitudinal section view of the light board according an embodiment of the present disclosure.
Figure 5:
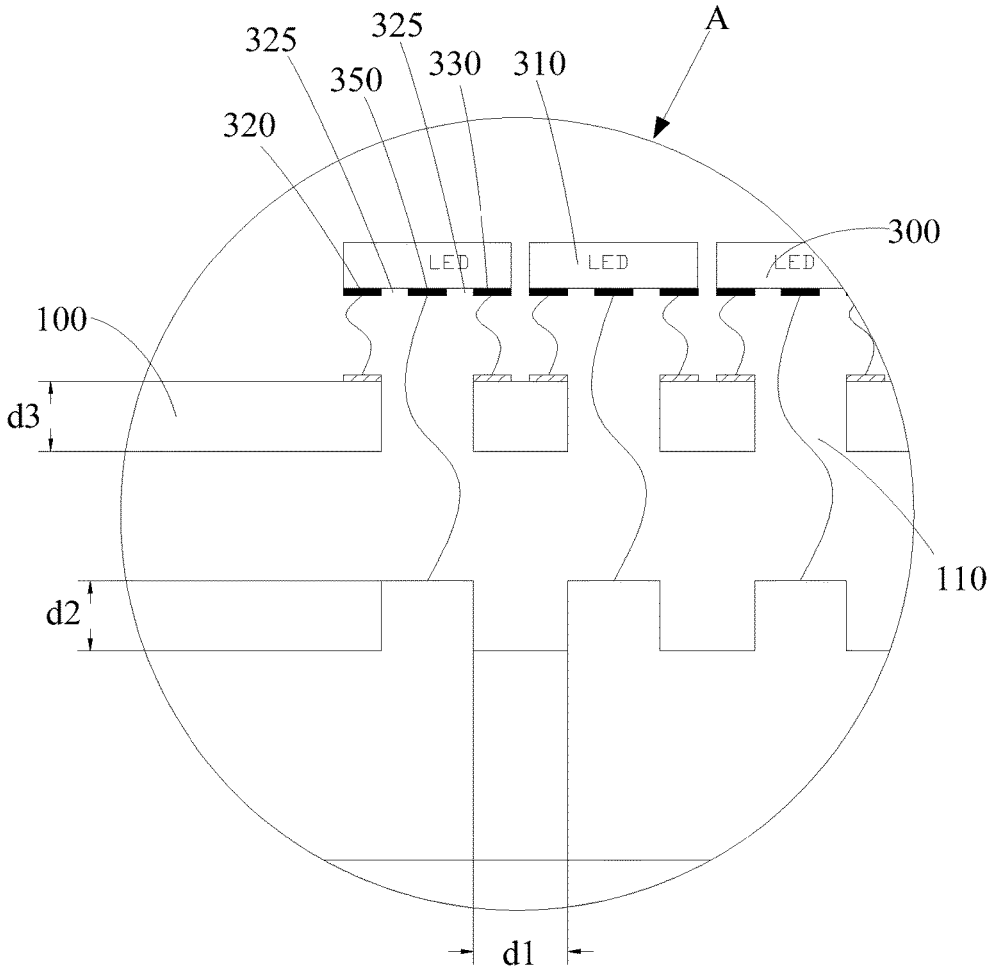
FIG. 5 is a partial enlarged view of part A in FIG. 4 according to an embodiment.
Figure 6:
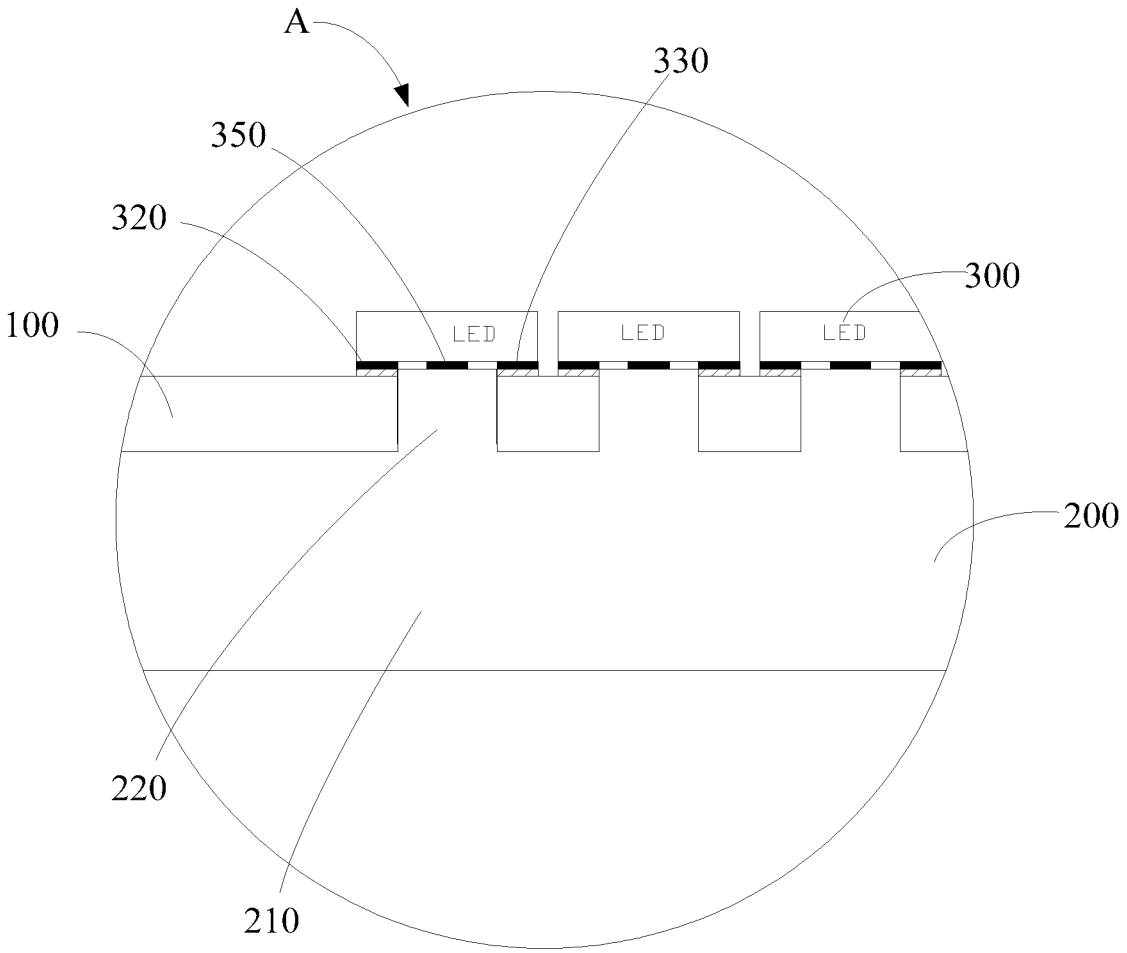
FIG. 6 is a partial enlarged view of part Ain FIG. 4 according to another embodiment.

The specific structure of the light board will be mainly described hereafter. Please refer to FIG. 4 to FIG. 6, the light board is used for a spotlight in an embodiment of the present disclosure. The light board comprises lamp beads 300, a circuit board 100, and a heat-conducting substrate 200. Each lamp bead 300 comprises a bead body 310, and a bottom of each bead body 310 is provided with a first electrode welding position 320, a second electrode welding position 330 and a heat-conducting welding position 350. There are isolating gaps 325 between any two of the first electrode welding position 320, the heat-conducting welding position 350, and the heat-conducting welding position 350. The circuit board 100 is provided with mounting positions for mounting the lamp bead 300. A positive electrode of the circuit board 100 is electrically connected to the first electrode welding position 320, and a negative electrode of the circuit board 100 is electrically connected to the second electrode welding position 330. The heat-conducting substrate 200 is welded to the heat-conducting welding position 350.

Specifically, in this embodiment, the lamp bead 300 may have different forms, and a LED lamp bead 300 is now taken as an example. The light emitted by the lamp beads 300 can be different, and white and warm color light are now taken as an example. The lamp bead 300 comprises a bead body 310. Three welding positions are provided at the bottom of each bead body 310, and the welding positions may be three positions, or may be three grooves or three bosses. In some embodiments, the welding positions are provided with weldable substances such as solder paste. Apparently, in some embodiments, the welding bosses may be made of weldable substances such as the solder paste. The three welding positions have many arrangements, for example, the heat-conducting welding position 350 is located between the first electrode welding position 320 and the second electrode welding position 330. There is an isolating gap 325 between the heat-conducting welding position 350 and the first electrode welding position 320. There is an isolating gap 325 between the heat-conducting welding position 350 and the second electrode welding position 330, and there is an isolating gap 325 between the first electrode welding position 320 and the second electrode welding position 330.

The circuit board 100 can have different forms, which can be a traditional rigid circuit board, or a Flexible Printed Circuit (FPC), which is a highly reliable and excellent flexible printed circuit board made of polyimide or polyester film. The circuit board 100 is a flexible circuit board 100 with a thickness d3 of 0.15 mm to 1 mm. The heat-conducting substrate 200 may be made of material with high thermal conduction, such as copper, ceramics with high thermal conduction etc. For example, the heat-conducting substrate 200 is a copper plate, a thickness d2 of a substrate body 210 is 1 mm to 3 mm, and/or a height of the heat-conducting boss 220 is 0.15 mm to 1 mm.

In this embodiment, by arranging the mutually independent (isolated) first electrode welding position 320, second electrode welding position 330 and heat-conducting welding position 350 on the lamp bead 300, so that the lamp bead 300 not only can be connected to the power supply source through the first electrode welding position 320 and the second electrode welding position 330, but also can be directly welded to the heat-conducting substrate 200 through the heat-conducting welding position 350, thus the heat generated by the light emission of the lamp bead 300 can be directly transferred to the heat-conducting substrate 200 and dissipated through the heat-conducting substrate 200. Meanwhile, in this embodiment, the electrical and thermal conduction of the lamp bead 300 are separated to achieve "the separation of the electrical and thermal conduction", so that the electrical and thermal conduction of the lamp bead 300 are independent of each other, so as to avoid the thermal conduction affecting the electrical conduction of the lamp bead 300, which is beneficial to improve the working stability of the light board.

In some embodiments, in order to improve the structural compactness and utilize the space more effectively, the circuit board 100 is provided with mounting holes 110. The positive and negative electrodes of the circuit board 100 are located on a surface of the circuit board 100 near the mounting hole 110. The heat-conducting substrate 200 is welded to the heat-conducting welding positions 350 through the mounting holes 110, and the circuit board 100 is located between the lamp beads 300 and the heat-conducting substrate 200.

Specifically, in this embodiment, the lamp beads 300 are arranged on a surface of the circuit board 100, and the heat-conducting substrate 200 is arranged on another surface of the circuit board 100. In some embodiments, in order to further improve the heat-dissipating effect and the structural compactness, a surface of the heat-conducting substrate 200 is attached to another surface of the circuit board 100. The heat-conducting substrate 200 is welded to the heat-conducting welding position 350 of the lamp bead 300 through the mounting hole 110, the first electrode welding position 320 of the lamp bead 300 is welded to the positive electrode of the circuit board 100, and the second electrode welding position 330 of the lamp bead 300 is welded to the negative electrode of the circuit board 100. In this way, the space is fully used and the structural compactness is improved, thus to avoid contact between the heat-conducting substrate 200 and the first electrode welding position 320 and the second electrode welding position 330, which is beneficial to improve the use safety of the light board.

In some embodiments, in order to further improve the heat-conducting effect, the heat-conducting substrate 200 comprises a substrate body 210 and heat-conducting bosses 220 arranged on the substrate body 210. The heat-conducting bosses 220 pass through the mounting holes 110 to be welded with the heat-conducting welding positions 350. In this way, the heat-conducting bosses 220 can be directly attached to the bottom of the lamp beads 300. A horizontal section of the heat-conducting boss 220 can have many shapes, for example, the horizontal section of the heat-conducting boss 220 is any one of a circle, an ellipse, a square, and a triangle. The horizontal sectional shape can be circular, so as to have more contact with the bottom of the lamp beads 300, thereby increasing the contact area and improving the heat-dissipating efficiency.

In some embodiments, in order to further improve the heat-dissipating effect, there is an avoiding gap between the adjacent two bosses 220, and a size d1 of the avoiding gap is 1 mm to 3 mm. The size of the avoiding gap limits a distance between the adjacent two lamp beads 300. The size of the avoiding gap cannot be too small, when it is less than 1 mm, the adjacent two lamp beads 300 are too close, which is not conducive to dissipate heat and also is not convenient for arranging the lamp beads 300. The size of the avoiding gap cannot be too large, when it is larger than 3 mm, the distance between the adjacent two lamp beads 300 is too far, which is not conducive to the arrangement of the lamp beads 300, so that the efficiency and effect of the light board cannot be guaranteed.

In some embodiments, a horizontal section area of the heat-conducting boss 220 is larger than respective areas of the first electrode welding position 320, the second electrode welding position 330, and the heat-conducting welding position 350. Specifically, in this embodiment, by setting the horizontal section area of the heat-conducting boss 220 larger than the respective areas of the first electrode welding position 320, the second electrode welding position 330, and the heat-conducting welding position 350, an area ratio of the heat-conducting boss 220 is larger, so that the heat-conducting boss 220 can better transfer the heat generated by the light beads 300 to the heat-conducting substrate 200, which is beneficial to improve the heat-dissipating efficiency.

In some embodiments, in order to improve the working stability of the light board, there are gaps between the heat-conducting bosses 220 and the first and second electrode welding position (320, 330) after the heat-conducting bosses 220 are welded to the heat-conducting welding positions 350. The thermal conduction is completely isolated from the electrical conduction by setting the gaps.

Figure 7:
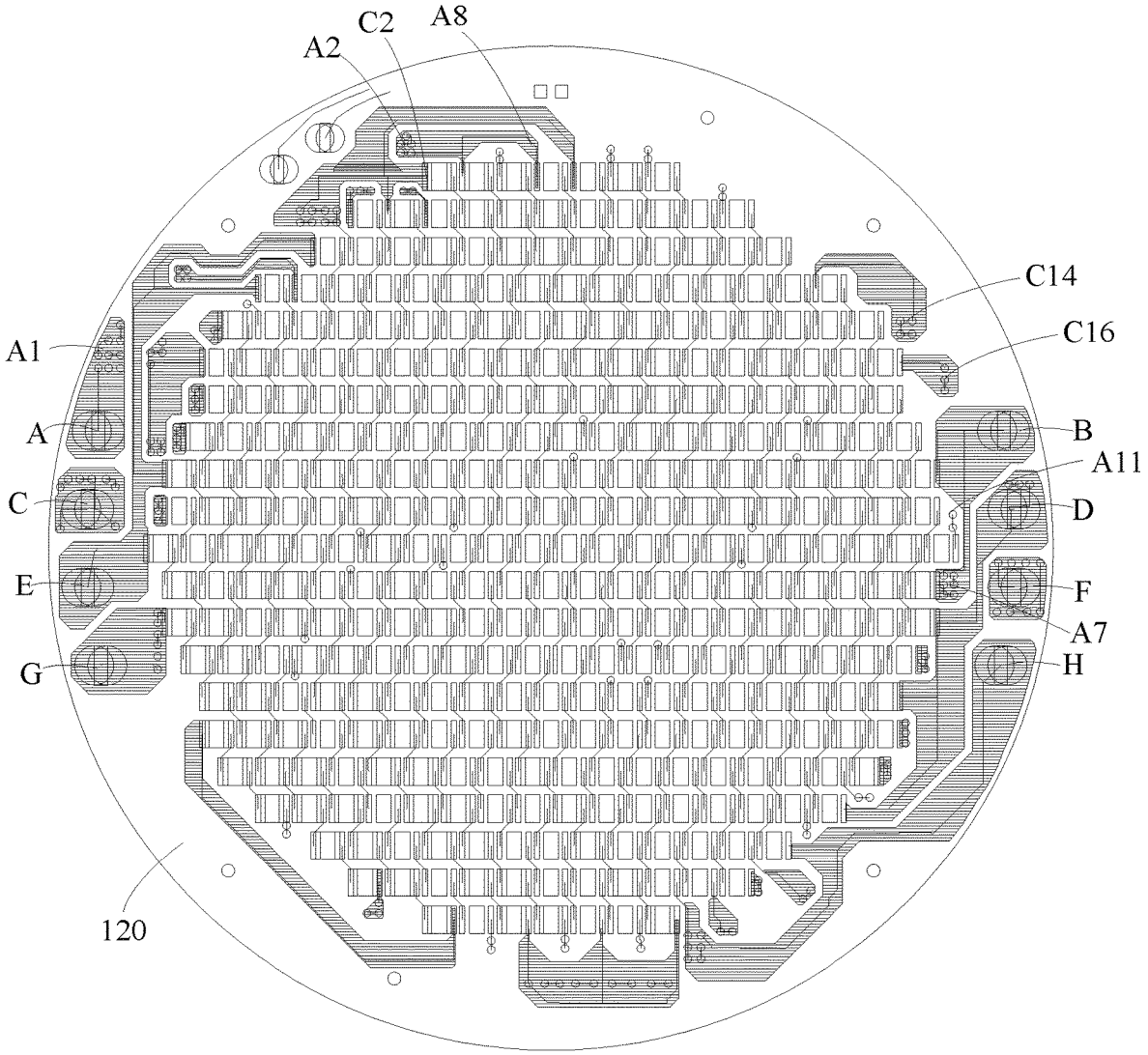
FIG. 7 is a schematic structural view of a top layer circuit of the light board according to an embodiment of the present disclosure.
Figure 9:
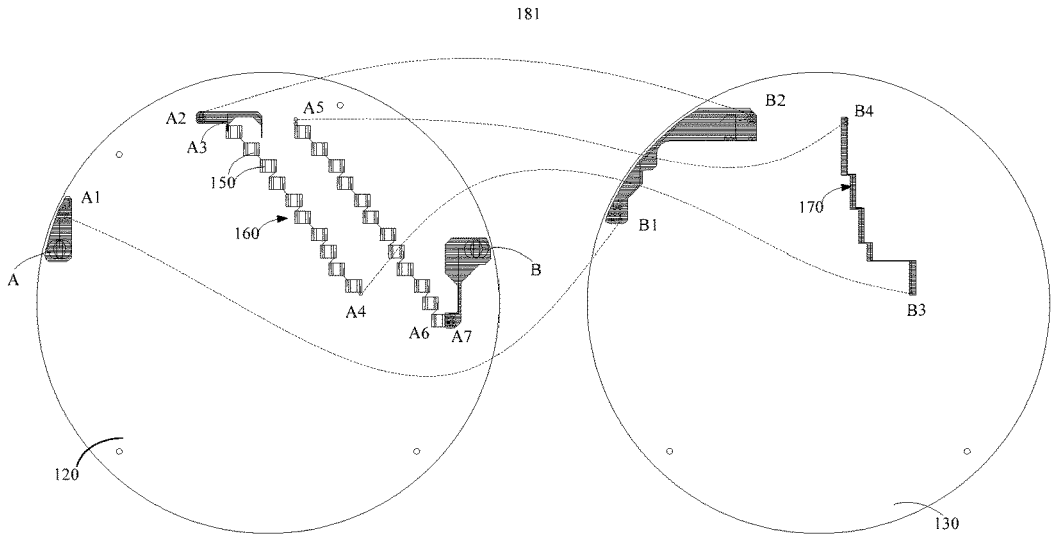
FIG. 9 is a schematic connection view of a first connecting line of the light board according to an embodiment of the present disclosure.

Referring to FIG. 7 and FIG. 9, the present disclosure further provides a line structure of the light board to adapt to the new arrangements of the lamp beads 300. The lamp beads 300 have many new arrangements, and the arrangement of the lamp beads 300 mentioned in the above embodiment is taken as an example.

The light board comprises lamp beads 300 and a circuit board 100. Each lamp bead 300 comprises cool color lamp beads 370 and/or warm color lamp beads 360, which are arranged to form lamp bead rows. The lamp bead rows are arranged along a first direction. The circuit board 100 is provided with mounting positions 150. The lamp beads 300 are mounted on the mounting positions 150. The circuit board has a top layer circuit 120 and a bottom layer circuit 130. The top layer circuit 120 comprises disconnected top layer circuit units 160, and the bottom layer circuit 130 comprises disconnected bottom layer circuit units 170. The top layer circuit 120 comprises a positive electrode and a negative electrode. There are connecting lines arranged in parallel between the positive electrode and the negative electrode, and any one of the connecting line is used to connect the lamp beads 300 in the same type in the plurality of lamp bead rows. The connecting lines are formed by connecting partial top layer circuit units 160 and partial bottom layer circuit units 170 in series.

Specifically, in this embodiment, the circuit board 100 can comprises a top layer structure and a bottom layer structure, the top layer circuits 120 are arranged on the top layer structure, and the bottom layer circuits 130 are arranged on the bottom layer structure. Apparently, in some embodiments, the top layer circuits 120 and the bottom layer circuits 130 can be arranged on two opposite and insulated sides of the same structure. The top layer circuit units 160 may be completely independent of each other, but the top layer circuit units 160 connected with the same pair of positive electrode and negative electrode can also be connected. Similarly, the bottom layer circuit units 170 may be completely independent of each other, but the bottom layer circuit units 170 connected with the same pair of positive electrode and negative electrode can also be connected. However, only when the top layer circuit unit 160 is mutually cooperated with the bottom layer circuit unit 170 can the connecting line form a loop. The top layer circuit 120 can also comprise electrical connecting blocks. The electrical connecting blocks may be arranged between the positive electrode and each top layer circuit unit 160, or between the negative electrode and each top layer circuit unit 160, or between the top layer circuit units 160. By setting the electrical connecting blocks, the top layer circuits 120 can be simplified, so that the connection and arrangement between the top layer circuit units 160 have more design space, which is more beneficial for forming a simpler and more stable line.

In this embodiment, any one of the connecting lines is used to connect the lamp beads 300 in the same type in the plurality of lamp bead rows, so that the lamp beads 300 on the same connecting line are of the same type (all are warm color lamp beads 360 or all are cool color lamp beads 360), which is beneficial to better control the brightness of the lamp beads 300, besides, the lamp beads 300 on the same connecting line work more stably (the lamp beads 300 are of the same type and will not interfere with each other). Meanwhile, the connecting line is formed by connecting partial top layer circuit units 160 and partial bottom layer circuit units 170 in series, so that the arrangement of the connecting lines are more flexible, thus to form a more reasonable line arrangement. Especially when there are lots of connecting lines, the space can be fully utilized, and the space utilization and structural compactness can be improved.

In some embodiments, the top layer circuit unit 160 is connected to mounting positions 150 located in different lamp bead rows, and the lamp bead rows connected by the same top layer circuit unit 160 are arranged adjacently in sequence; and/or, the bottom layer circuit unit 170 is arranged in a strip shape or a block shape for connecting two different positions of the bottom layer circuit 130. Specifically, in this embodiment, the lamp beads 300 connected to the same top layer circuit unit 160 are the lamp beads 300 in the adjacent lamp bead rows, so that the continuity of each top layer circuit unit 160 is greatly increased, especially when the lamp beads 300 connected to the top layer circuit unit 160 are adjacent to each other and arranged in staggered positions, the connecting efficiency of the top layer circuit units 160 can be greatly increased. An overall shape of the connected top layer circuit unit 160 is an inclined straight line.

In some embodiments, in order to reduce the number of the positive electrodes and negative electrodes, the connecting lines comprise at least two top layer circuit units 160 and two bottom layer circuit units 170. The connecting lines are formed by alternately connecting the top layer circuit units 160 and the bottom layer circuit units 170 in series. Specifically, in this embodiment, each connecting line is configured to comprises at least two top layer circuit units 160 and two bottom layer circuit units 170, so that the number of lamp beads 300 connected to the same connecting line is increased, thus the connecting efficiency of the single connecting line is greatly improved, which is beneficial to reduce the number of positive electrodes and negative electrodes, thereby improving the rationality and simplicity of entire line.

In some embodiments, in order to simplify the circuit structure of the light board and increase the number of the lamp beads 300 that can be arranged on the light board, there are positive electrodes and negative electrodes, and there are connecting lines arranged in parallel between each positive electrode and the corresponding negative electrode, respectively. Specifically, in this embodiment, by setting the positive electrodes and the negative electrodes on the circuit board, the circuit board can run the circuits simultaneously, thereby simplifying the complexity of a single connecting line. Meanwhile, more lamp beads 300 can be arranged on the light board, so that the arrangement of the lamp beads 300 can be more flexible.

Figure 8:
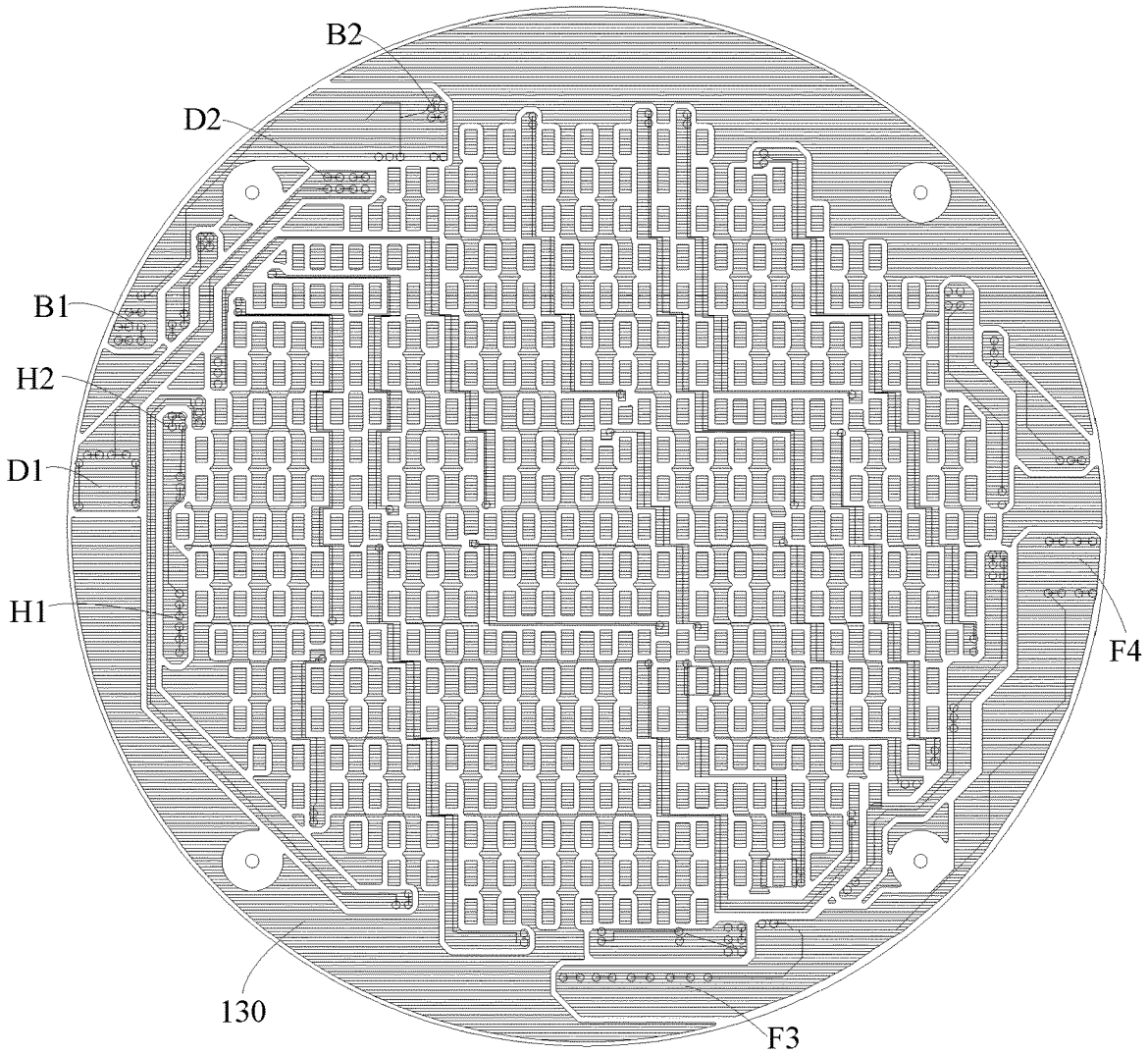
FIG. 8 is a schematic structural view of a bottom layer circuit of the light board according to an embodiment of the present disclosure.

Referring to FIG. 7 and FIG. 8, there can be pairs of positive and negative electrodes on the light board, which can be arranged according to the actual situation, such as 3 to 6 pairs. In this embodiment, the light board has 4 pairs of positive electrodes and negative electrodes as an example for description. There should not be too many pairs of electrodes, when it is more than 6 pairs, it will be unfavorable for the line arrangement on the outer edge of the light board and will increase the complexity of the outer lines. There should not be too less pairs of electrodes, when it less than 3 pairs, the connecting lines between each pair of electrodes are too complicated, which is not conducive to the flexible design of the line.

Specifically, the positive electrode comprises a positive electrode A, a positive electrode C, a positive electrode E, and a positive electrode G; and the negative electrodes comprises a negative electrode B, a negative electrode D, a negative electrode F, and a negative electrode H; wherein the positive electrode A corresponds to the negative electrode B, the positive electrode C corresponds to the negative electrode D, the positive electrode E corresponds to the negative electrode F, and the positive electrode G corresponds to the negative electrode H. The types of lamp beads 300 connected to each pair of electrodes may be the same or different, and there are many connecting methods. For example, the lamp beads 300 connected by the connecting lines between the positive electrode A and the negative electrode B, and between the positive electrode E and the negative electrode F are the cool color lamp beads 370; while the lamp beads 300 connected by the connecting lines between the positive electrode C and the negative electrode D, and between the positive electrode G and the negative electrode H are the warm color lamp beads 360.

The connecting lines between each pair of positive electrodes and negative electrodes are described in detail below. Referring to FIG. 9 to FIG. 12, there are a first connecting line 181, a second connecting line 182, a third connecting line 183 and a fourth connecting line 184 arranged in parallel between the positive electrode A and the negative electrode B. The first connecting line 181 is formed by the positive electrode A is connected with a starting point B1 of a first bottom layer circuit unit B1-B2 through a connecting point A1, a connecting point B2 is connected with a starting point A3 of a first top layer circuit unit A3-A4, a connecting point A4 is connected with a starting point B3 of a second bottom layer circuit unit B3-B4, a connecting point B4 is connected with a starting point A5 of a second top layer circuit unit A5-A6, and a connecting point A6 is connected with the negative electrode B. The second connecting line 182 is formed by: the positive electrode A is connected with the starting point B1 of the first bottom layer circuit unit B1-B2 through the connecting point A1, the connecting point B2 is connected with a starting point A8 of a third top layer circuit unit A8-A9, a connecting point A9 is connected with a starting point B5 of a third bottom layer circuit unit B5-B6, a connecting point B6 is connected with a starting point A10 of a fourth top layer circuit unit A10-A11, and a connecting point A11 is connected with the negative electrode B. The third connecting line 183 is that: the positive electrode A is connected with the starting point B1 of the first bottom layer circuit unit B1-B2 through the connecting point A1, the connecting point B2 is connected with a starting point A12 of a fifth top layer circuit unit A12-A13, a connecting point A13 is connected with a starting point B7 of a fourth bottom layer circuit unit B7-B8, a connecting point B8 is connected with a starting point A14 of a sixth top layer circuit unit A14-A15, a connecting point A15 is connected with a starting point B9 of a fifth bottom layer circuit unit B9-B10, and a connecting point B10 is connected with the negative electrode B. The fourth connecting line 184 is formed by: the positive electrode A is connected with the starting point B1 of the first bottom layer circuit unit B1-B2 through the connecting point A1, the connecting point B2 is connected with a starting point A16 of a seventh top layer circuit unit A16-A17, a connecting point A17 is connected with a starting point B11 of a sixth bottom layer circuit unit B11-B12, a connecting point B12 is connected with a starting point A18 of an eighth top layer circuit unit A18-A19, a connecting point A19 is connected with a starting point B13 of a seventh bottom layer circuit unit B13-B14, and a connecting point B14 is connected with the negative electrode B.

Specifically, in this embodiment, referring to FIG. 9, with regard to the first connecting line 181, the positive electrode A and the connecting point A1 are connected through an electrical connecting block, and the number of the connecting point A1 may be one or more. The positive electrode A is located at the edge on the middle left side of the circuit board, and the electrical connecting block is extended upwardly along the edge of the circuit board to connect with the connecting point A1. The first bottom layer circuit unit B1-B2 is located at the left edge of the bottom layer circuit 130, the connecting point B1 is arranged corresponding to the connecting point A1, and the two of them can be electrically connected by means of wires, pins or welding. The connecting point B2 is located at the upper left of the bottom layer circuit 130. A connecting point A2 is arranged at the position corresponding to the connecting point B2 on the top layer circuit 120. The connecting point A2 is electrically connected with the connecting point A3 and the connecting point A8 through the electrical connecting block, and the connecting point A3 and the connecting point A8 are electrically connected to the connecting point A2 to realize the electrical connection with the connecting point B2. The first top layer circuit unit A3-A4 is extended from the connecting point A3 towards the lower right to the connecting point A4. The number of the lamp beads 300 connected to the first top layer circuit unit A3-A4 can be such as 7 to 12, taking 10 as an example. The connecting point B3 is arranged on the bottom layer circuit 130 at the position corresponding to the connecting point A3, and the second bottom layer circuit unit B3-B4 is extended leftwards first, and then upwards to the connecting point B4. The connecting point A5 is arranged on the top layer circuit 120 at the position corresponding to the connecting point B4, and the second top layer circuit unit A5-A6 is extended from the connecting point A5 towards the lower right to the connecting point A6. The number of the lamp beads 300 connected to the second top layer circuit unit A5-A6 may be 9 to 15, taking 12 as an example. The second top layer circuit unit A5-A6 is located on the right of the first top layer circuit unit A3-A4. The connecting point A6 is connected to the negative electrode B through an electrical connecting block, and the electrical connecting block is extended upwardly from the connecting point A6 to the negative electrode B.

Figure 10:
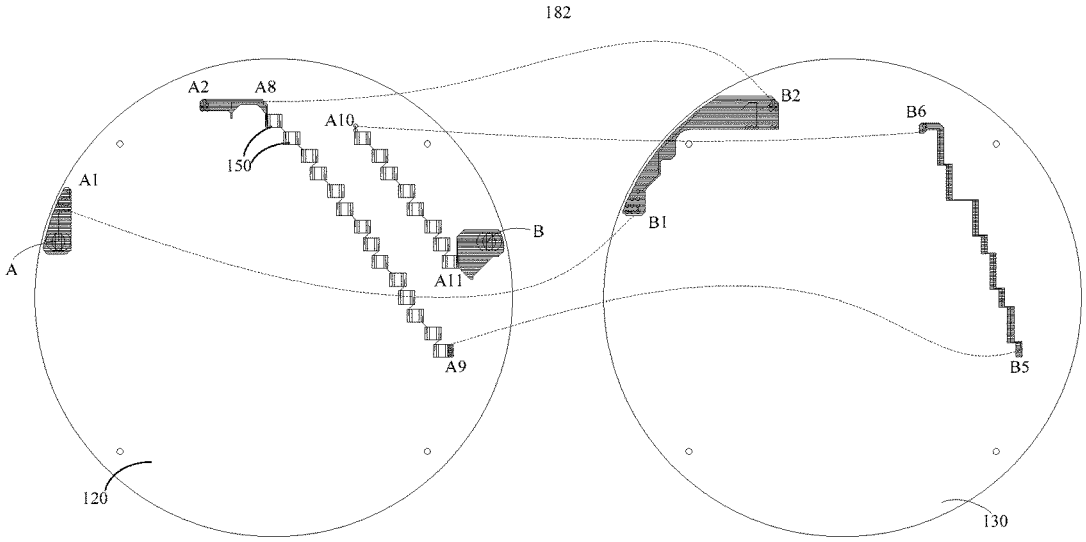
FIG. 10 is a schematic connection view of a second connecting line of the light board according to an embodiment of the present disclosure.

Referring to FIG. 10, with regard to the second connecting line 182, the positive electrode A, the connecting point A1, the first bottom layer circuit unit B1-B2 and the connecting point A8 thereof are the same as the first connecting line 181, which will not be repeated herein. The third top layer circuit unit A8-A9 is extended from the connecting point A8 towards the lower right to the connecting point A9, and the third top layer circuit unit A8-A9 is located between the first top layer circuit unit A3-A4 and the second top layer circuit unit A5-A6. The number of the lamp beads 300 connected to the third top layer circuit unit A8-A9 may be 12 to 16, taking 14 as an example. The connecting point B5 is provided on the bottom layer circuit 130 at a position corresponding to the connecting point A9. The third bottom layer circuit unit B5-B6 is extended towards the upper left to the connecting point B6. The connecting point A10 is provided on the top layer circuit 120 at the position corresponding to the connecting point B6, and the fourth top layer circuit unit A10-A11 is extended from the connecting point A10 towards the lower right to the connecting point A11. The fourth top layer circuit unit A10-A11 is located on the right side of the second top layer circuit unit A5-A6. The number of the lamp beads 300 connected to the fourth top layer circuit unit A10-A11 may be 6 to 10, taking 8 as an example. The connecting point A11 is connected to the negative electrode B through an electrical connecting block, and the electrical connecting block is extended rightwardly from the connecting point A11 to the negative electrode B.

Figure 11:
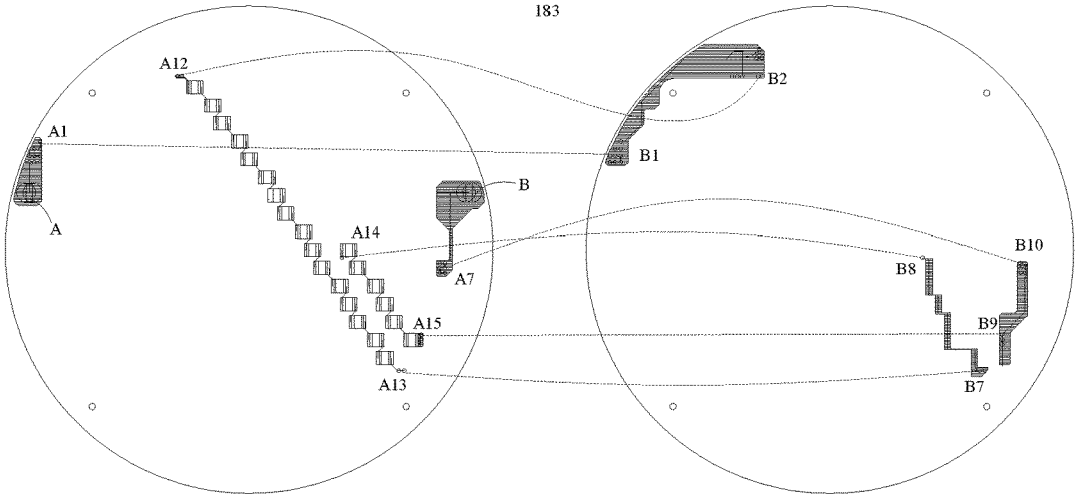
FIG. 11 is a schematic connection view of a third connecting line of the light board according to an embodiment of the present disclosure.

Referring to FIG. 11, with regard to the third connecting line 183, the positive electrode A, the connecting point A1 and the first bottom layer circuit unit B1-B2 thereof are the same as the first connecting line 181, which will not be repeated herein. It is worth noting that, there may be connecting points B2, and all of them are located at the end of the first bottom layer circuit unit B1-B2 away from the connecting point B1, so that the connecting points B2 correspond to the connecting point A2, the connecting point A12, and the connecting point A16, respectively. In addition, the connecting point A2, the connecting point A12 and the connecting point A16 are connected through the electrical connecting block.

The fifth top layer circuit unit A12-A13 is extended from the connecting point A12 towards the lower right to the connecting point A13. The fifth top layer circuit unit A12-A13 is located on the left side of the first top layer circuit unit A3-A4. The number of the lamp beads 300 connected to the fifth top layer circuit unit A12-A13 may be 14 to 18, taking 16 as an example. A connecting point B7 is arranged on the bottom layer circuit 130 at the position corresponding to the connecting point A13, and the fourth bottom layer circuit unit B7-B8 is extended towards the upper left to the connecting point B8. A connecting point A14 is arranged on the top layer circuit 120 at the position corresponding to the connecting point B8, and the sixth top layer circuit unit A14-A15 is extended from the connecting point A14 towards the lower right to the connecting point A15. The sixth top layer circuit unit A14-A15 is located on the right side of the fifth top layer circuit unit A12-A13. The number of the lamp beads 300 connected to the sixth top layer circuit unit A14-A15 may be 4 to 8, taking 6 as an example. A connecting point B9 is arranged on the bottom layer circuit 130 at the position corresponding to the connecting point A15, and the fifth bottom layer circuit unit B9-B10 is extended towards the upper right to the connecting point B10. A connecting point A7 is provided on the top layer circuit 120 at the position corresponding to the connecting point B10, the connecting point A7 is connected to the negative electrode B through an electrical connecting block, and the electrical connecting block is extended upwardly from the connecting point A7 to the negative electrode B. The connecting point A7 and the connecting point A6 are adjacently arranged.

Figure 12:
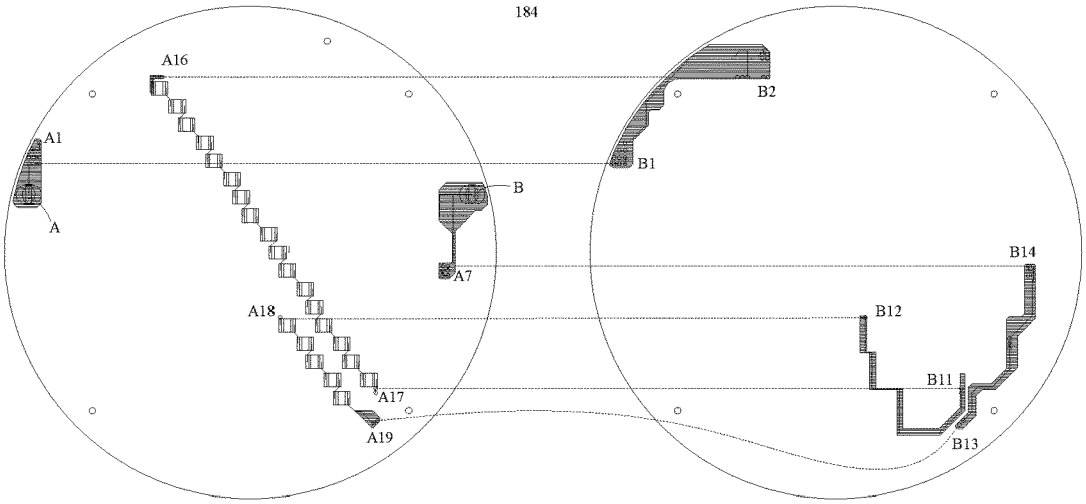
FIG. 12 is a schematic connection view of a fourth connecting line of the light board according to an embodiment of the present disclosure.

Referring to FIG. 12, with regard to the fourth connecting line 184, the positive electrode A, the connecting point A1, the first bottom layer circuit unit B1-B2, and the connecting point A16 thereof are the same as those in the above embodiment, which will not be repeated herein. The seventh top layer circuit unit A16-A17 is extended from the connecting point A16 towards the lower right to the connecting point A17. The seventh top layer circuit unit A16-A17 is located on the left side of the fifth top layer circuit unit A12-A13. The number of the lamp beads 300 connected to the seventh top layer circuit unit A12-A13 may be 15 to 19, taking 17 as an example. A connecting point B11 is arranged on the bottom layer circuit 130 corresponding to the connecting point A17, and the sixth bottom layer circuit unit B11-B12 is first extended towards the lower left, then extended towards the upper left to the connecting point B12. A connecting point A18 is arranged on the top layer circuit 120 at the position corresponding to the connecting point B12, and the eighth top layer circuit unit A18-A19 is extended from the connecting point A18 towards the lower right to the connecting point A19. The connecting point A19 is electrically connected to the adjacent mounting position 150 through the electrical connecting block. The eighth top layer circuit unit A18-A19 is located on the right side of the seventh top layer circuit unit A16-A17. The number of the lamp beads 300 connected to the eighth top layer circuit unit A18-A19 may be 3 to 7, taking 5 as an example. A connecting point B13 is arranged on the bottom layer circuit 130 at the position corresponding to the connecting point A19, and the seventh bottom layer circuit unit B13-B14 is extended towards the upper right to the connecting point B14. It should be noted that, in some embodiments, in order to utilize space more effectively, the seventh bottom layer circuit unit B13-B14 may be partially overlapped with the fifth bottom layer circuit unit B9-B10, and the connecting point B14 may be adjacent to or overlapped with the connecting point B10. The connecting point A7 is provided on the top layer circuit 120 corresponding to the connecting point B14 (there can be connecting points A7 arranged adjacently), and the connecting point A7 is connected to the negative electrode B through an electrical connecting block, and the electrical connecting block is extended upwardly to the negative electrode B. The connecting point A7 and the connecting point A6 are adjacently arranged.

Referring to FIG. 13 to FIG. 16, there are a fifth connecting line 185, a sixth connecting line 186, a seventh connecting line 187 and an eighth connecting line 188 between the positive electrode C and the negative electrode D. The fifth connecting line 185 is formed b: the positive electrode C is connected with a starting point D1 of an eighth bottom layer circuit unit D1-D2, a connecting point D2 is connected with a starting point C2 of a ninth top layer circuit unit C2-C3, a connecting point C3 is connected with a starting point D3 of a ninth bottom layer circuit unit D3-D4, a connecting point D4 is connected with a starting point C4 of a tenth top layer circuit unit C4-C5, and a connecting point C5 is connected with the negative electrode D. The sixth connecting line 186 is that: the positive electrode C is connected with the starting point D1 of the eighth bottom layer circuit unit D1-D2, the connecting point D2 is connected with a starting point C6 of an eleventh top layer circuit unit C6-C7, a connecting point C7 is connected with a starting point D5 of a tenth bottom layer circuit unit D5-D6, a connecting point D6 is connected with a starting point C8 of a twelfth top layer circuit unit C8-C9, and a connecting point C9 is connected with the negative electrode D. The seventh connecting line 187 is that: the positive electrode C is connected with the starting point D1 of the eighth bottom layer circuit unit D1-D2, the connecting point D2 is connected with a starting point C10 of a thirteenth top layer circuit unit C10-C11, a connecting point C11 is connected with a starting point D7 of an eleventh bottom layer circuit unit D7-D8, a connecting point D8 is connected with a starting point C12 of a fourteenth top layer circuit unit C12-C13, a connecting point C13 is connected with a starting point D9 of a twelfth bottom layer circuit unit D9-D10, a connecting point D10 is connected with a starting point C15 of a fifteenth top layer circuit unit C15-C16, a connecting point C16 is connected with a starting point D11 of a thirteenth bottom layer circuit unit D11-D12, and a connecting point D12 is connected with the negative electrode D. The eighth connecting line 188 is that: the positive electrode C is connected with the starting point D1 of the first bottom layer circuit unit D1-D2, the connecting point D2 is connected to the starting point C1 of a sixteenth top layer circuit unit C1-C17, a connecting point C17 is connected to a starting point D13 of a fourteenth bottom layer circuit unit D13-D14, a connecting point D14 is connected with a starting point C18 of a seventeenth top layer circuit unit C18-C19, and a connecting point C19 is connected with the negative electrode D.

Figure 13:
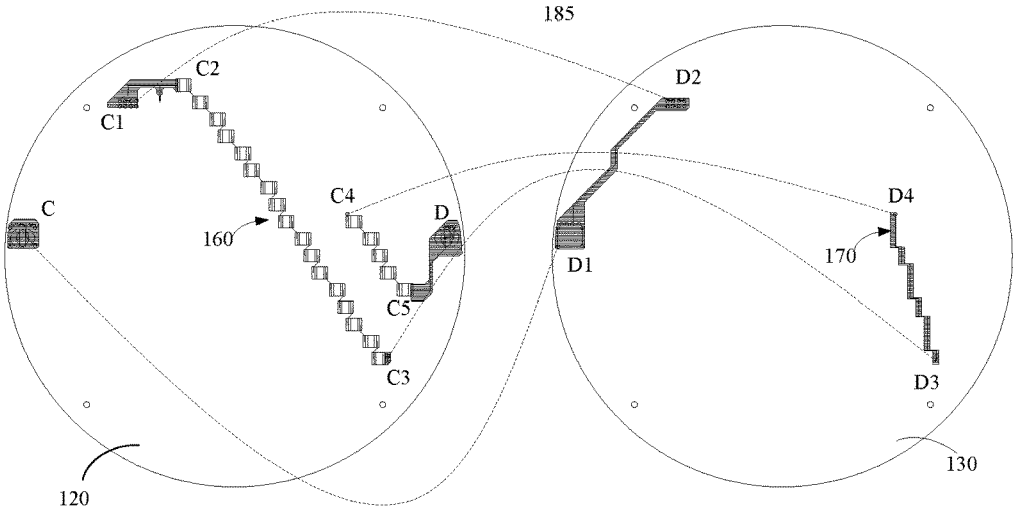
FIG. 13 is a schematic connection view of a fifth connecting line of the light board according to an embodiment of the present disclosure.

Specifically, in this embodiment, referring to FIG. 13, with regard to the fifth connecting line 185, one or more connecting points can be provided at the positive electrode C, when the connecting points are provided, all of them can be connected to the outside through the positive electrode C. The positive electrode C is located at the edge on the middle left side of the circuit board, and the positive electrode C is located directly below the positive electrode A. The positive electrode C and the positive electrode A are arranged independently of each other.

The eighth bottom layer circuit unit D1-D2 is located on the left side edge of the bottom layer circuit 130, the connecting point D1 is arranged corresponding to the connecting point at the positive electrode C, and the two of them can be electrically connected by means of wires, pins or welding. The connecting point D2 is located on upper left of the bottom layer circuit 130. The connecting point C1 is arranged on the top layer circuit 120 at the position corresponding to the connecting point D2. The connecting point C1 is electrically connected with the connecting point C2 and the connecting point C6 through an electrical connecting block, and the connecting point C2 and the connecting point C6 are electrically connected to the connecting point C1 to realize the electrical connection with the connecting point D2. The ninth top layer circuit unit C2-C3 is extended from the connecting point C2 towards the lower right to the connecting point C3. The ninth top layer circuit unit C2-C3 are located on the left side of the first top layer circuit unit A3-A4 and are arranged adjacently. The number of the lamp beads 300 connected to the ninth top layer circuit unit C2-C3 can be 15 to 19, taking 17 as an example. A connecting point D3 is arranged on the bottom layer circuit 130 at the position corresponding to the connecting point C3, and the ninth bottom layer circuit unit D3-D4 is extended towards the upper left to the connecting point D4. A connecting point C4 is arranged on the top layer circuit 120 at the position corresponding to the connecting point D4, and the tenth top layer circuit unit C4-C5 extends from the connecting point C4 towards the lower right to the connecting point C5. The tenth top layer circuit unit C4-C5 is located on the right of the ninth top layer circuit unit C2-C3. The number of the lamp beads 300 connected to the tenth top layer circuit unit C4-C5 may be 3 to 7, taking 5 as an example. The connecting point C5 is connected to the negative electrode D through an electrical connecting block, and the electrical connecting block is extended from the connecting point C5 towards the upper right to the negative electrode D.

Figure 14:
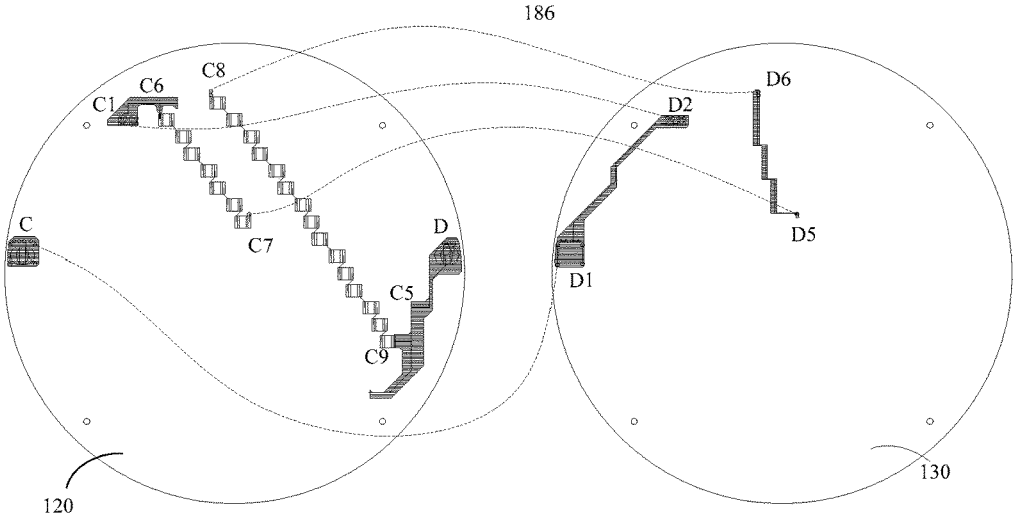
FIG. 14 is a schematic connection view of a sixth connecting line of the light board according to an embodiment of the present disclosure.

Referring to FIG. 14, with regard to the sixth connecting line 186, the positive electrode C, the connecting point C1, the eighth bottom layer circuit unit D1-D2, and the connecting point C6 thereof are the same as those in the above embodiment, which will not be repeated herein. The eleventh top layer circuit unit C6-C7 is extended from the connecting point C6 towards the lower right to the connecting point C7, and the eleventh top layer circuit unit C6-C7 is located on the left side of the ninth top layer circuit unit C2-C3. The number of the lamp beads 300 connected to the eleventh top layer circuit unit C6-C7 can be 5 to 9, taking 7 as an example. A connecting point D5 is arranged on the bottom layer circuit 130 at the position corresponding to the connecting point C7, and the tenth bottom layer circuit unit D5-D6 is extended towards the upper left to the connecting point D6. A connecting point C8 is arranged on the top layer circuit 120 at the position corresponding to the connecting point D6, and the twelfth top layer circuit unit C8-C9 is extended from the connecting point C8 towards the lower right to the connecting point C9. The twelfth top layer circuit unit C8-C9 is located on the right side of the eleventh top layer circuit unit C6-C7. The number of the lamp beads 300 connected to the twelfth top layer circuit unit C8-C9 can be 13 to 17, taking 15 as an example. The connecting point C9 is connected to the negative electrode D through an electrical connecting block, and the electrical connecting block is extended from the connecting point C9 towards the upper right to the negative electrode D. In some embodiments, in order to more effectively utilize the space, the electrical connecting block is passed through the connecting point C5.

Figure 15:
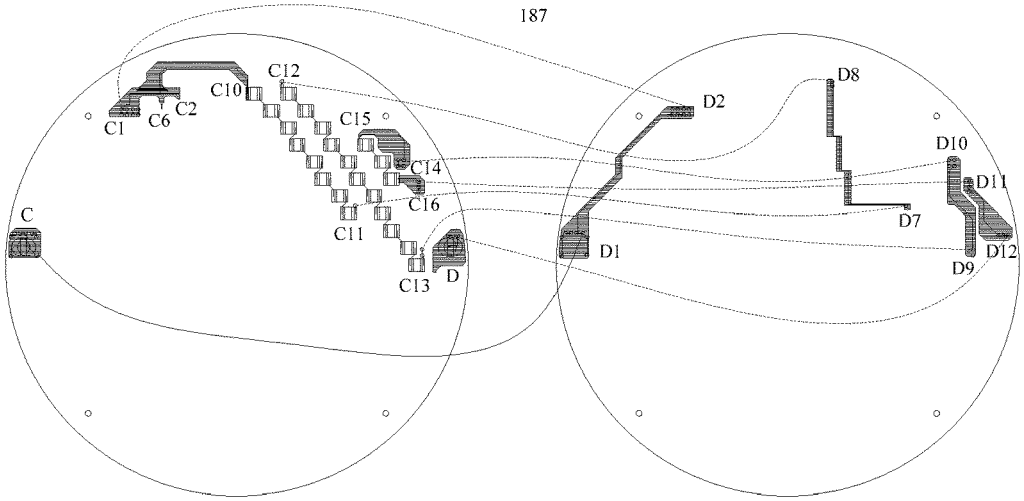
FIG. 15 is a schematic connection view of a seventh connecting line of the light board according to an embodiment of the present disclosure.

Referring to FIG. 15, with regard to the seventh connecting line 187, the positive electrode C, the connecting point C1 and the eighth bottom layer circuit unit D1-D2 thereof are the same as those in the above embodiment, which will not be repeated herein. It should be noted that, in some embodiments, in order to save space, the connecting point C1, the connecting point C2, the connecting point C6 and the connecting point C10 can be connected through the same electrical connecting block.

The thirteenth top layer circuit unit C10-C11 is extended from the connecting point C10 towards the lower right to the connecting point C11, and the thirteenth top layer circuit unit C10-C11 is located on the left side of the ninth top layer circuit unit C2-C3. The number of the lamp beads 300 connected to the thirteenth top layer circuit unit C10-C11 can be 6 to 10, taking 8 as an example. A connecting point D7 is arranged on the bottom layer circuit 130 at the position corresponding to the connecting point C11, and the eleventh bottom layer circuit unit D7-D8 is extended leftwards first, and then upwards to the connecting point D8. A connecting point C12 is arranged on the top layer circuit 120 at the position corresponding to the connecting point D8, and the fourteenth top layer circuit unit C12-C13 is extended from the connecting point C12 towards the lower right to the connecting point C13. The fourteenth top layer circuit unit C12-C13 is located on the right side of the thirteenth top layer circuit unit C10-C11. The number of the lamp beads 300 connected to the fourteenth top layer circuit unit C12-C13 can be 9 to 113, taking 11 as an example. A connecting point D9 is arranged on the bottom layer circuit 130 at the position corresponding to the connecting point C13, and the twelfth bottom layer circuit unit D9-D10 is extended towards the upper left to the connecting point D10. The connecting point C14 is arranged on the top layer circuit 120 corresponding to the connecting point D10, and the connecting point C14 is extended from the upper left to the connecting point C15 through an electrical connecting block. The fifteenth top layer circuit unit C15-C16 is extended from the connecting point C15 towards the lower right to the connecting point C16, wherein the connecting point C16 is electrically connected to the adjacent mounting position 150 through the connecting block. A connecting point D11 is arranged on the bottom layer circuit 130 at the position corresponding to the connecting point C16, and the thirteenth bottom layer circuit unit D11-D12 is extended from the connecting point D11 towards the lower right to the connecting point D12. The negative electrode D is provided with a connecting point corresponding to the connecting point D12, and the connecting point D12 can be electrically connected to the negative electrode D through the corresponding connecting point.

Figure 16:
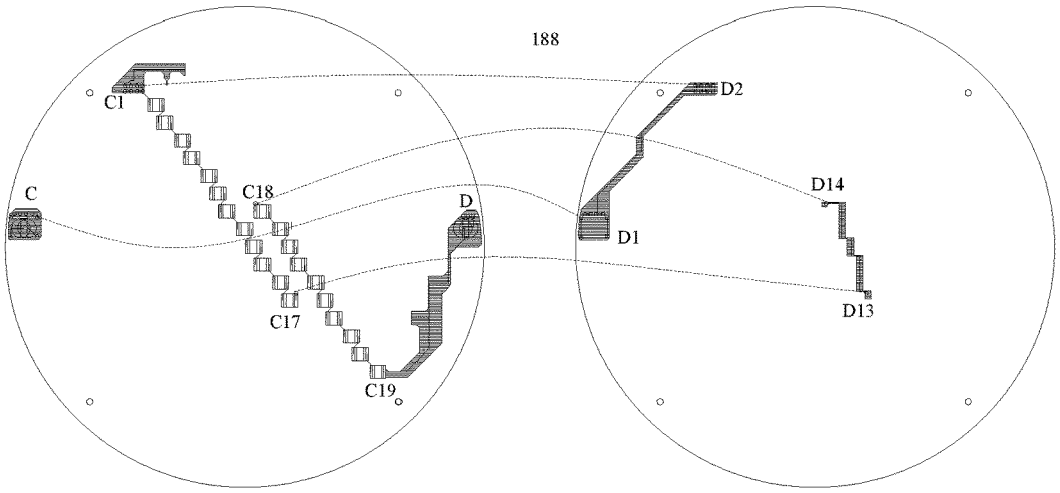
FIG. 16 is a schematic connection view of an eighth connecting line of the light board according to an embodiment of the present disclosure.

Referring to FIG. 16, with regard to the seventh connecting line 188, the positive electrode C, the connecting point C1, and the eighth bottom layer circuit unit D1-D2 thereof are the same as those in the above embodiments, which will not be repeated herein. The sixteenth top layer circuit unit C1-C17 is extended from the connecting point C1 towards the lower right to the connecting point C17. The sixteenth top layer circuit unit C1-C17 is located on the left side of the eleventh top layer circuit unit C6-C7. The number of the lamp beads 300 connected to the sixteenth top layer circuit unit C1-C17 can be multiple, such as 10 to 14, taking 12 as an example. A connecting point D13 is arranged on the bottom layer circuit 130 at the position corresponding to the connecting point C17, and the fourteenth bottom layer circuit unit D13-D14 is extended towards the upper left to the connecting point D14. A connecting point C18 is provided on the top layer circuit 120 at the position corresponding to the connecting point D14, and the seventeenth top layer circuit unit C18-C19 is extended from the connecting point C18 towards the lower right to the connecting point C19. The connecting point C19 is electrically connected to the negative electrode D at the upper right position through an electrical connecting block. The seventeenth top layer circuit unit C18-C19 is located on the right side of the sixteenth top layer circuit unit C1-C17. The number of the lamp beads 300 connected to the seventeenth top layer circuit unit C18-C19 can be 8 to 12, taking 10 as an example. In some embodiments, in order to simplify the circuit, the electrical connecting block connecting the connecting point C19 and the negative electrode D can pass through the connecting point C9 and the connecting point C5.

Referring to FIG. 17 to FIG. 20, there are a ninth connecting line 189, a tenth connecting line 190, an eleventh connecting line 191 and a twelfth connecting line 192 between the positive electrode E and the negative electrode F. The ninth connecting line 189 is that: the positive electrode E is connected with a starting point E1 of an eighteenth top layer circuit unit E1-E2, a connecting point E2 is connected with a starting point E3 of a nineteenth top layer circuit unit E3-E4, a connecting point E4 is connected with a starting point F1 of a fifteenth bottom layer circuit unit F1-F2, a connecting point F2 is connected with a starting point E5 of a twentieth top layer circuit unit E5-E6, a connecting point E6 is connected with a starting point F3 of a sixteenth bottom layer circuit unit F3-F4, and a connecting point F4 is connected with the negative electrode F. The tenth connecting line 190 is that: the positive electrode E is connected with a starting point E7 of a twenty-first top layer circuit unit E7-E8, a connecting point E8 is connected with a starting point F5 of a seventeenth bottom layer circuit unit F5-F6, a connecting point F6 is connected with a starting point E9 of a twenty-second top layer circuit unit E9-E10, a connecting E11) is connected with the starting point F3 of the sixteenth bottom layer circuit unit F3-F4, and the connecting point F4 is connected with the negative electrode F. The eleventh connecting line 191 is that: the positive electrode E is connected with a starting point E11 of a twenty-third top layer circuit unit E11-E12, a connecting point E12 is connected with a starting point F7 of an eighteenth bottom layer circuit unit F7-F8, a connecting point F8 is connected with a starting point E13 of a twenty-fourth top layer circuit unit E13-E14, a connecting point E14 is connected with the starting point F3 of the sixteenth bottom layer circuit unit F3-F4, and the connecting point F4 is connected with the negative electrode F. The twelfth connecting line 192 is that: the positive electrode E is connected with a starting point E15 of a twenty-fifth top layer unit E15-E16, a connecting point E16 is connected with a starting point F9 of a nineteenth bottom layer circuit unit F9-F10, a connecting point F10 is connected with a starting point E17 of a twenty-sixth top layer circuit unit E17-E18, a connecting point E18 is connected to a starting point F11 of a twentieth bottom layer circuit unit F11-F4, and the connecting point F4 is connected with the negative electrode F.

Figure 17:
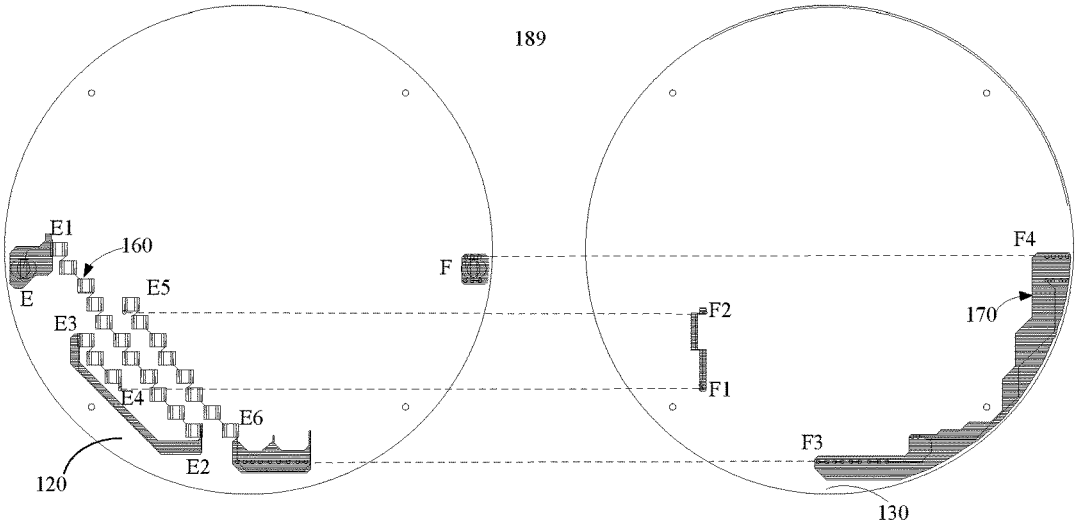
FIG. 17 is a schematic connection view of a ninth connecting line of the light board according to an embodiment of the present disclosure.

Specifically, in this embodiment, referring to FIG. 17, with regard to the ninth connecting line 189, the positive electrode E and the connecting point E1 are connected through an electrical connecting block, and the number of the connecting points E1 may be one or more. The positive electrode E is located at the edge on the middle left side of the circuit board, and the electrical connecting block is extended towards the upper right to connect with the connecting point E1. The positive electrode E is located directly below the positive electrode C, and the positive electrode E and the positive electrode C are independent of each other.

The eighteenth top layer circuit unit E1-E2 is extended from the connecting point E1 to the lower right to the connecting point E2. The number of the lamp beads 300 connected to the eighteenth top layer circuit unit E1-E2 can be 9 to 13, taking 11 as an example. The connecting point E2 and the connecting point E3 are connected by an electrical connecting block, and the electrical connecting block is extended to the upper left. The nineteenth top layer circuit unit E3-E4 is extended from the connecting point E3 to the connecting point E4, the nineteenth top layer circuit unit E3-E4 is located between the eighteenth top layer circuit unit E1-E2 and the electrical connecting block (E2-E3). The number of the lamp beads 300 connected to the nineteenth top layer circuit unit E3-E4 can be 2 to 4, taking 3 as an example.

The connecting point F1 is arranged on the bottom layer circuit 130 corresponding to the connecting point E4, and the fifteenth bottom layer circuit unit F1-F2 is extended upwardly to the connecting point F2. The connecting point F2 is located at the lower left of the bottom layer circuit 130. A connecting point E5 is arranged on the top layer circuit 120 at the position corresponding to the connecting point F2, and the twentieth top layer circuit unit E5-E6 is extended from the connecting point E5 toward to the lower right to the connecting point E6. The number of the lamp beads 300 connected to the twentieth top layer circuit unit E5-E6 can be 6 to 10, taking 8 as an example. The connecting point E6 is extended to a lower connecting point through an electrical connecting block, and the lower connecting point corresponds to a connecting point on the sixteenth bottom layer circuit unit F3-F4. It is worth noting that the electrical connecting block connected to the connecting point E6 is also connected to the connecting point E10 and the connecting point E14. The connecting block is provided with connecting points, and the connecting points are respectively arranged corresponding to the connecting points on the sixteenth bottom layer circuit unit F3-F4 (there may be connecting points F3, which are arranged adjacently and corresponding to the connecting points E6, E10 and E14, respectively). The sixteenth bottom layer circuit unit F3-F4 is extended to the upper right along the edge of the circuit board to the connecting point F4, and there may be one or more connecting points F4. The position of the connecting point F4 corresponds to the position of the negative electrode F, so that the two are easily electrically connected.

Figure 18:
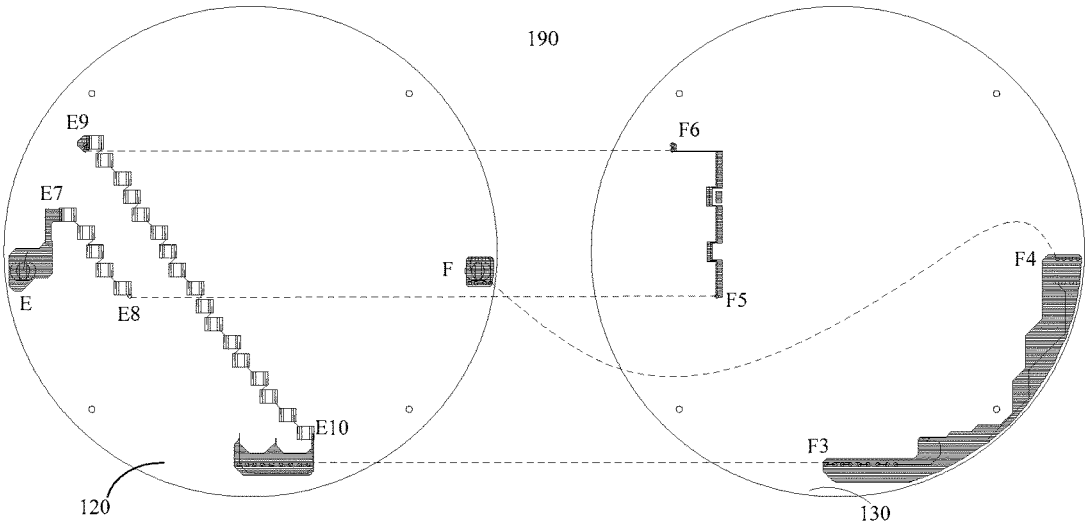
FIG. 18 is a schematic connection view of a tenth connecting line of the light board according to an embodiment of the present disclosure.

Referring to the FIG. 18, with regard to the tenth connecting line 190, the positive electrode E and the connecting point E7 are connected by an electrical connecting block, and there may be one or more connecting points E7. The electrical connecting block is extended to the upper right to connect with the connecting point E7. In some embodiments, to simplify the circuit, the positive electrode E, the connecting point E1, the connecting point E7, the connecting point E11 and the connecting point E15 can be located on the same electrical connecting block.

The twenty-first top layer circuit unit E7-E8 is extended from the connecting point E7 towards the lower right to the connecting point E8. The number of the lamp beads 300 connected to the twenty-first top layer circuit unit E7-E8 can be 3 to 7, and taking 5 as an example. The connecting point F5 is arranged on the bottom layer circuit 130 corresponding to the connecting point E8. The seventeenth bottom layer circuit unit F5-F6 is extended upwards first, and then leftward to the connecting point F6. The connecting point F6 is located at the upper left of the bottom layer circuit 130. The connecting point E9 is arranged on the top layer circuit 120 at the position corresponding to the connecting point F6, and the twenty-second top layer circuit unit E9-E10 is extended from the connecting point E9 towards the lower right to the connecting point E10. The number of the lamp beads 300 connected to the twenty-second top layer circuit unit E9-E10 can be 15 to 19, taking 17 as an example. The connecting point E10 is extended to a lower connecting point through the electrical connecting block, and the lower connecting point corresponds to the connecting point on the sixteenth bottom layer circuit unit F3-F4. The sixteenth bottom layer circuit unit F3-F4 is extended to the upper right along the edge of the circuit board to the connecting point F4, and there may be one or more connecting points F4. The position of the connecting point F4 corresponds to the position of the negative electrode F, so that the two are easily electrically connected.

Figure 19:
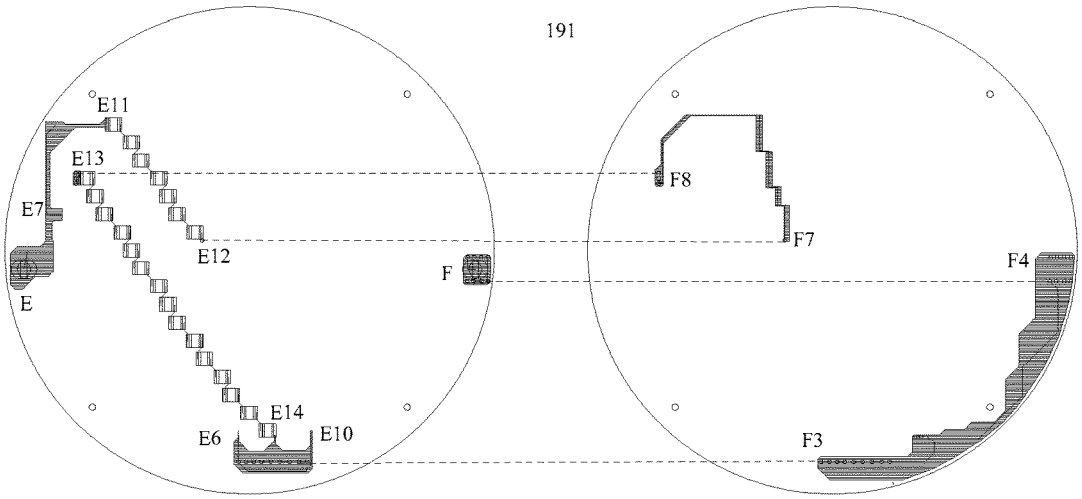
FIG. 19 is a schematic connection view of an eleventh connecting line of the light board according to an embodiment of the present disclosure.

Referring to the FIG. 19, with regard to the eleventh connecting line 191, the positive electrode E and the connecting point E11 are connected by an electrical connecting block, and there may be one or more connecting points E11. The electrical connecting block is extended to the upper right to connect with the connecting point E11.

The twenty-third top layer circuit unit E11-E12 is extended from the connecting point E11 towards the lower right to the connecting point E12. The number of the lamp beads 300 connected to the twenty-third top layer circuit unit E11-E12 can be 5 to 9, taking 7 as an example. A connecting point F7 is arranged on the bottom layer circuit 130 at the position line corresponding to the connecting point E12, and the eighteenth bottom layer circuit unit F7-F8 is extended upward first, then extended to the left, and next extended downward to the connecting point F8. The connecting point F8 is located at the upper left of the bottom layer circuit 130. A connecting point E13 is arranged on the top layer circuit 120 at the position corresponding to the connecting point F8, and the twenty-fourth top layer circuit unit E13-E14 is extended from the connecting point E13 towards the lower right to the connecting point E14. The number of the lamp beads 300 connected to the twenty-fourth top layer circuit unit E13-E14 can be 13 to 17, taking 15 as an example. The connecting point E14 is extended to a lower connecting point through the electrical connecting block, and the lower connecting point corresponds to the connecting point on the sixteenth bottom layer circuit unit F3-F4. Subsequent connections refer to the above-mentioned embodiments, which are not repeated herein.

Figure 20:
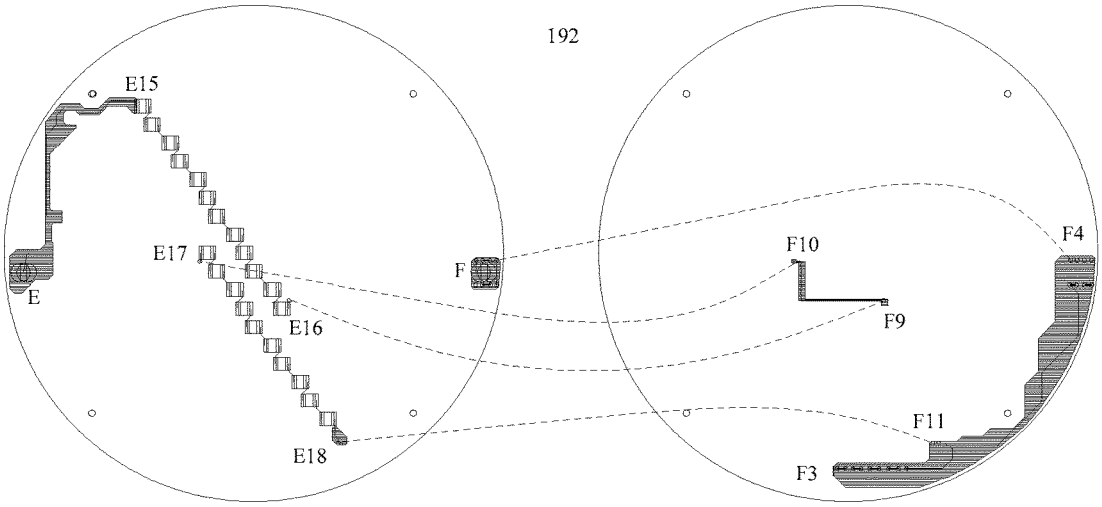
FIG. 20 is a schematic connection view of a twelfth connecting line of the light board according to an embodiment of the present disclosure.

Referring to the FIG. 20, with regard to the twelfth connecting line 192, the positive electrode E and the connecting point E15 are connected by an electrical connecting block, and there may be one or more connecting points E15. The electrical connecting block is extended to the upper right to connect with the connecting point E15.

The twenty-fifth top layer circuit unit E15-E16 is extended from the connecting point E15 towards the lower right to the connecting point E16. The number of the lamp beads 300 connected to the twenty-fifth top layer circuit unit E15-E16 can be 10 to 14, taking 12 as an example. A connecting point F9 is arranged on the bottom layer circuit 130 corresponding to the connecting point E16, and the nineteenth bottom layer circuit unit F9-F10 is extended leftward first, and then upwardly to the connecting point F10. The connecting point F10 is located on a lower portion of the bottom layer circuit 130 near the middle. A connecting point E17 is arranged on the top layer circuit 120 at the position corresponding to the connecting point F10, and the twenty-sixth top layer circuit unit E17-E18 is extended from the connecting point E17 towards the lower right to the connecting point E18. The number of the lamp beads 300 connected to the twenty-sixth top layer circuit unit E17-E18 can be multiple, such as 8 to 12, taking 10 as an example. A connecting point F11 is arranged on the bottom layer circuit 130 corresponding to the connecting point E18, and the connecting point F11 is a beginning of the twentieth bottom layer circuit unit F11-F4. In some embodiments, in order to simplify the circuit, the twentieth bottom layer circuit unit F11-F4 and the sixteenth bottom layer circuit unit F3-F4 may be partially overlapped. Subsequent connections refer to the above-mentioned embodiments, which will not be repeated herein.

Referring to FIG. 21 to FIG. 24, there are a thirteenth connecting line 193, a fourteenth connecting line 194, a fifteenth connecting line 195 and a sixteenth connecting line 196 between the positive electrode G and the negative electrode H. The thirteenth connecting line 193 is formed by: the positive electrode G is connected with a starting point H1 of a twenty-first bottom layer circuit unit H1-H2, a connecting point H2 is connected with a starting point G1 of a twenty-seventh top layer circuit unit G1-G2, a connecting point G2 is connected with a starting point H3 of a twenty-second bottom layer circuit unit H3-H4, a connecting point H4 is connected with a starting point G3 of a twenty-eighth top layer circuit unit G3-G4, a connecting point G4 is connected with a starting point H5 of a twenty-third bottom layer circuit unit H5-H6, and a connecting point H6 is connected with a starting point G5 of an electrical connecting block G5-H. The fourteenth connecting line 194 is that: the positive electrode G is connected with a starting point G6 of a twenty-ninth top layer circuit unit G6-G7, a connecting point G7 is connected with a starting point H7 of a twenty-fourth bottom layer circuit unit H7-H8, a connecting point H8 is connected with a starting point G8 of a thirtieth top layer circuit unit G8-G9, a connecting point G9 is connected with the starting point H5 of the twenty-third bottom layer circuit unit H5-H6, and the connecting point H6 is connected with the starting point G5 of the electrical connecting block G5-H. The fifteenth connecting line 195 is that: the positive electrode G is connected with the starting point H1 of the twenty-first bottom layer circuit unit H1-H2, the connecting point H2 is connected with a starting point G11 of a thirty-first top layer circuit unit G11-G12, a connecting point G12 is connected with a starting point H9 of a twenty-fifth bottom layer circuit unit H9-H10, a connecting point H10 is connected with a starting point G13 of a thirty-second top layer circuit unit G13-G5, and the connecting point G5 is connected with the negative electrode H through the electrical connecting block G5-H. The sixteenth connecting line 196 is that: the positive electrode G is connected with the starting point H1 of the twenty-first bottom layer circuit unit H1-H2, the connecting point H2 is connected with a starting point G10 of an electrical connecting block G10-G11, a connecting point G11 is connected with a starting point H11 of a twenty-sixth bottom layer circuit unit H11-H12, a connecting point H12 is connected with a starting point G15 of a thirty-third top layer circuit unit G15-G16, a connecting point G16 is connected with a starting point H13 of a twenty-seventh bottom layer circuit unit H13-H14, a connecting point H14 is connected with a starting point G17 of a thirty-fourth top layer circuit unit G17-G18, and a connecting point G18 is connected with the negative electrode H through an electrical connecting block G18-H.

Figure 21:
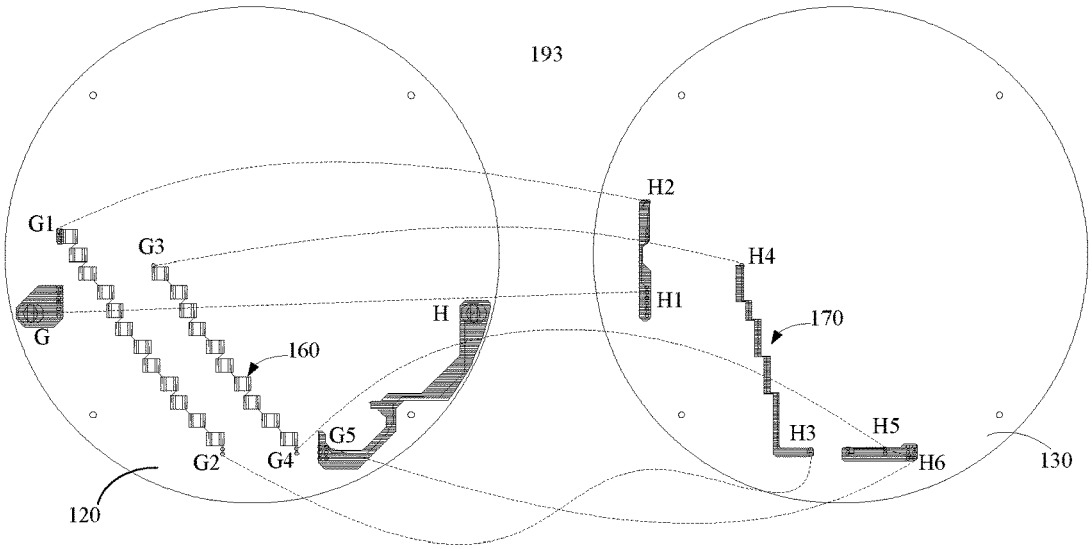
FIG. 21 is a schematic connection view of a thirteenth connecting line of the light board according to an embodiment of the present disclosure.

Specifically, in this embodiment, referring to FIG. 21, with regard to the thirteenth connecting line 193, one or more connecting points can be provided at the positive electrode G, when connecting points are provided, all of them can be connected to the outside through the positive electrode G. The positive electrode G is located at the edge on the middle left side of the circuit board, and the positive electrode G is located directly below the positive electrode E. The positive electrode G and the positive electrode E are arranged independently of each other.

The twenty-first bottom layer circuit unit H1-H2 is located on the left side of the bottom layer circuit 130, the connecting point H1 is arranged corresponding to the connecting point at the positive electrode G, and the two of them can be electrically connected by means of wires, pins or welding. The connecting point H2 is located at the upper left of the bottom layer circuit 130. A connecting point G1 is arranged on the top layer circuit 120 at the position corresponding to the connecting point H2. The twenty-seventh top layer circuit unit G1-G2 is extended from the connecting point G1 towards the lower right to the connecting point G2, and the twenty-seventh top layer circuit unit G1-G2 is located on the left side of the first top layer circuit unit A3-A4. The number of the lamp beads 300 connected to the twenty-seventh top layer circuit unit G1-G2 can be multiple, such as 10 to 14, taking 12 as an example. The connecting point H3 is arranged on the bottom layer circuit 130 at the position corresponding to the connecting point G2, and the twenty-second bottom layer circuit unit H3-H4 is extended leftward first, and then upwards to the connecting point H4. A connecting point G3 is provided on the top layer circuit 120 at the position corresponding to the connecting point H4, and the twenty-eighth top layer circuit unit G3-G4 is extended from the connecting point G3 towards the lower right to the connecting point G4. The twenty-eighth top layer circuit unit G3-G4 is located on the right side of the twenty-seventh top layer circuit unit G1-G2. The number of the lamp beads 300 connected to the twenty-eighth top layer circuit unit G3-G4 may be 8 to 12, taking 10 as an example. The connecting point H5 is arranged on the bottom layer circuit 130 at the position corresponding to the connecting point G4, and the twenty-third bottom layer circuit unit H5-H6 is extended rightward to the connecting point H6. A connecting point G5 is arranged on the top layer circuit 120 at the position corresponding to the connecting point H6, the connecting point G5 is connected to the negative electrode H through an electrical connecting block, and the electrical connecting block is extended from the connecting point G5 towards the upper right to the negative electrode H.

Figure 22:
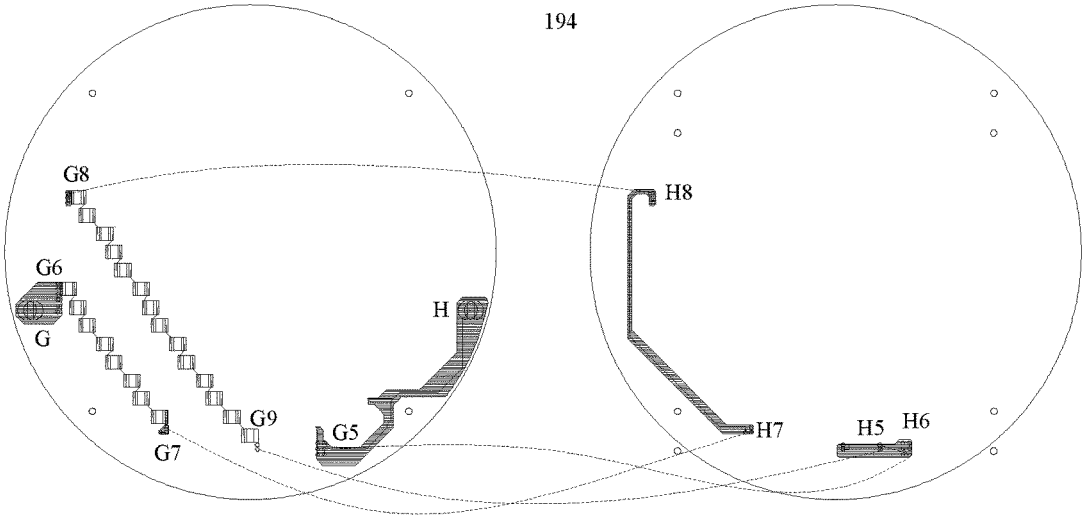
FIG. 22 is a schematic connection view of a fourteenth connecting line of the light board according to an embodiment of the present disclosure.

Referring to FIG. 22, with regard to the fourteenth connecting line 194, the positive electrode G is connected to the connecting point G6 through an electrical connecting block. The twenty-ninth top layer circuit unit G6-G7 is extended from the connecting point G6 towards the lower right to the connecting point G7. The twenty-ninth top layer circuit unit G6-G7 is located on the left side of the twenty-seventh top layer circuit unit G1-G2. The number of the lamp beads 300 connected to the twenty-ninth top layer circuit unit G6-G7 can be 7 to 10, taking 8 as an example. The connecting point H7 is arranged on the bottom layer circuit 130 corresponding to the connecting point G7. The twenty-fourth bottom layer circuit unit H7-H8 is first extended leftward, then extended to the upper left, next extended upward, and last extended rightward to the connecting point H8. A connecting point G8 is provided on the top layer circuit 120 at the position corresponding to the connecting point H8, and the thirtieth top layer circuit unit G8-G9 is extended from the connecting point G8 towards the lower right to the connecting point G9. The thirtieth top layer circuit unit G8-G9 is located on the right side of the twenty-ninth top layer unit G6-G7. The number of the lamp beads 300 connected to the thirtieth top layer circuit unit G8-G9 may be multiple, such as 12 to 16, taking 14 as an example. There can be connecting points H5 arranged adjacently on the twenty-third bottom layer circuit unit H5-H6, and the connecting points H5 are arranged corresponding to the connecting point G4 and the connecting point G9 respectively. The connecting point G5 is arranged on the top layer circuit 120 at the position corresponding to the connecting point H6, and the subsequent connections refer to the above-mentioned embodiments, which will not be repeated herein.

Figure 23:
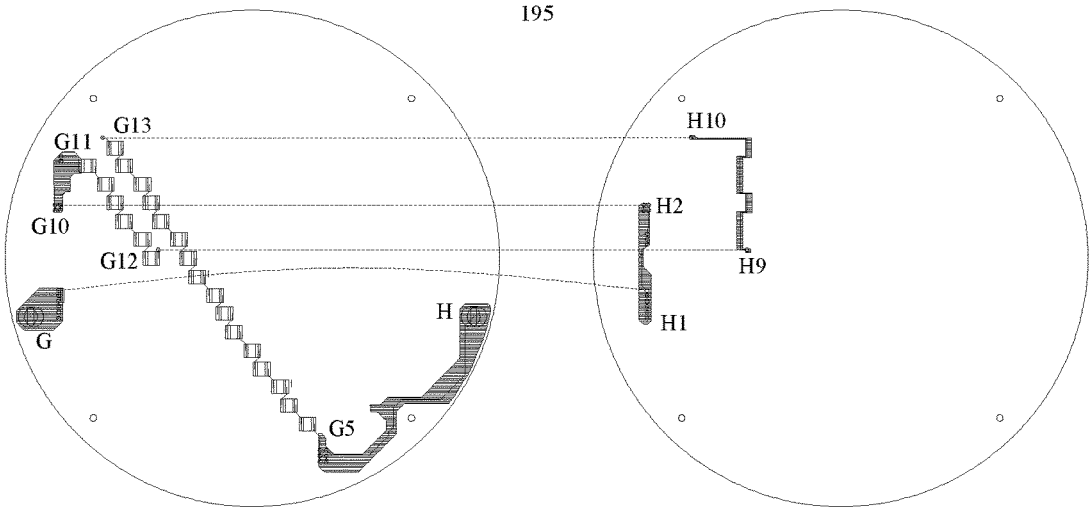
FIG. 23 is a schematic connection view of a fifteenth connecting line of the light board according to an embodiment of the present disclosure.

Referring to FIG. 23, with regard to the fifteenth connecting line 195, the positive electrode G and the twenty-first bottom layer circuit unit H1-H2 thereof are the same as those in the above embodiment, which will not be repeated herein. It should be noted that, in some embodiments, there can be connecting points H2 corresponding to the connecting point G1 and the connecting point G10, respectively. Apparently, in some embodiments, the connecting point G1 and the connecting point G10 can be overlapped. In this case, only one connecting point H2 is required. The connecting point G10 is connected to the connecting point G11 through an electrical connecting block, so that the connecting point G11 is connected to the twenty-first bottom layer circuit H1-H2 unit through the electrical connecting block and the connecting point G10.

The thirty-first top layer circuit unit G11-G12 is extended from the connecting point G11 towards the lower right to the connecting point G12. The number of the lamp beads 300 connected to the thirty-first top layer circuit unit G11-G12 can be 4 to 8, taking 6 as an example. A connecting point H9 is arranged on the bottom layer circuit 130 at the position corresponding to the connecting point G12, and the twenty-fifth bottom layer circuit unit H9-H10 is first extended upwardly, and then extended leftward to the connecting point H10. A connecting point G13 is arranged on the top layer circuit 120 at the position corresponding to the connecting point H10, and the thirty-second top layer circuit unit G13-G5 is extended from the connecting point G13 towards the lower right to the connecting point G5. The thirty-second top layer circuit unit G13-G5 is located on the right side of the thirty-first top layer circuit unit G11-G12. The number of the lamp beads 300 connected to the thirty-second top layer circuit unit G13-G5 may be multiple, such as 14 to 18, taking 16 is as an example. Subsequent connections refer to the above-mentioned embodiments, which will not be repeated herein.

Figure 24:
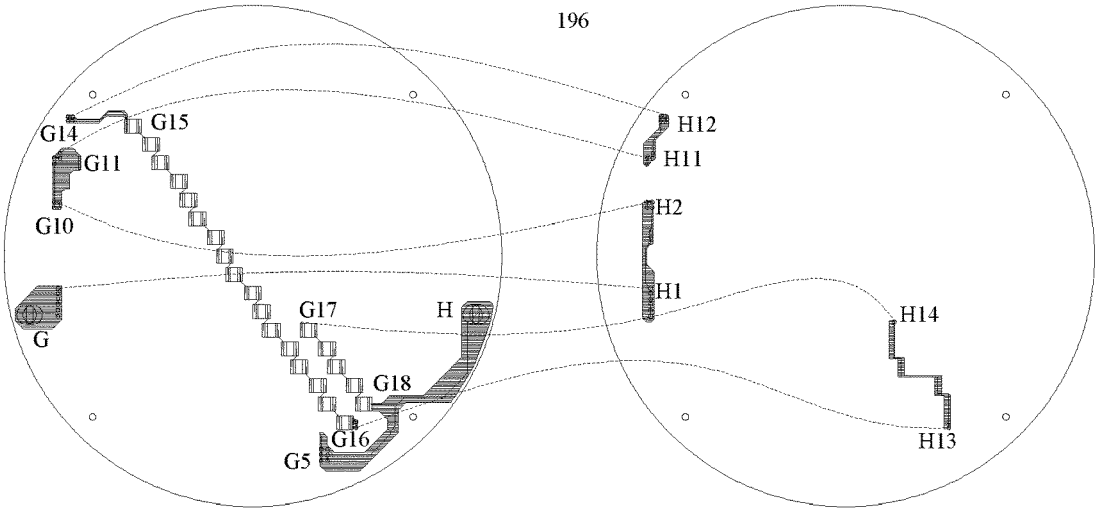
FIG. 24 is a schematic connection view of a sixteenth connecting line of the light board according to an embodiment of the present disclosure.
Figure 25:
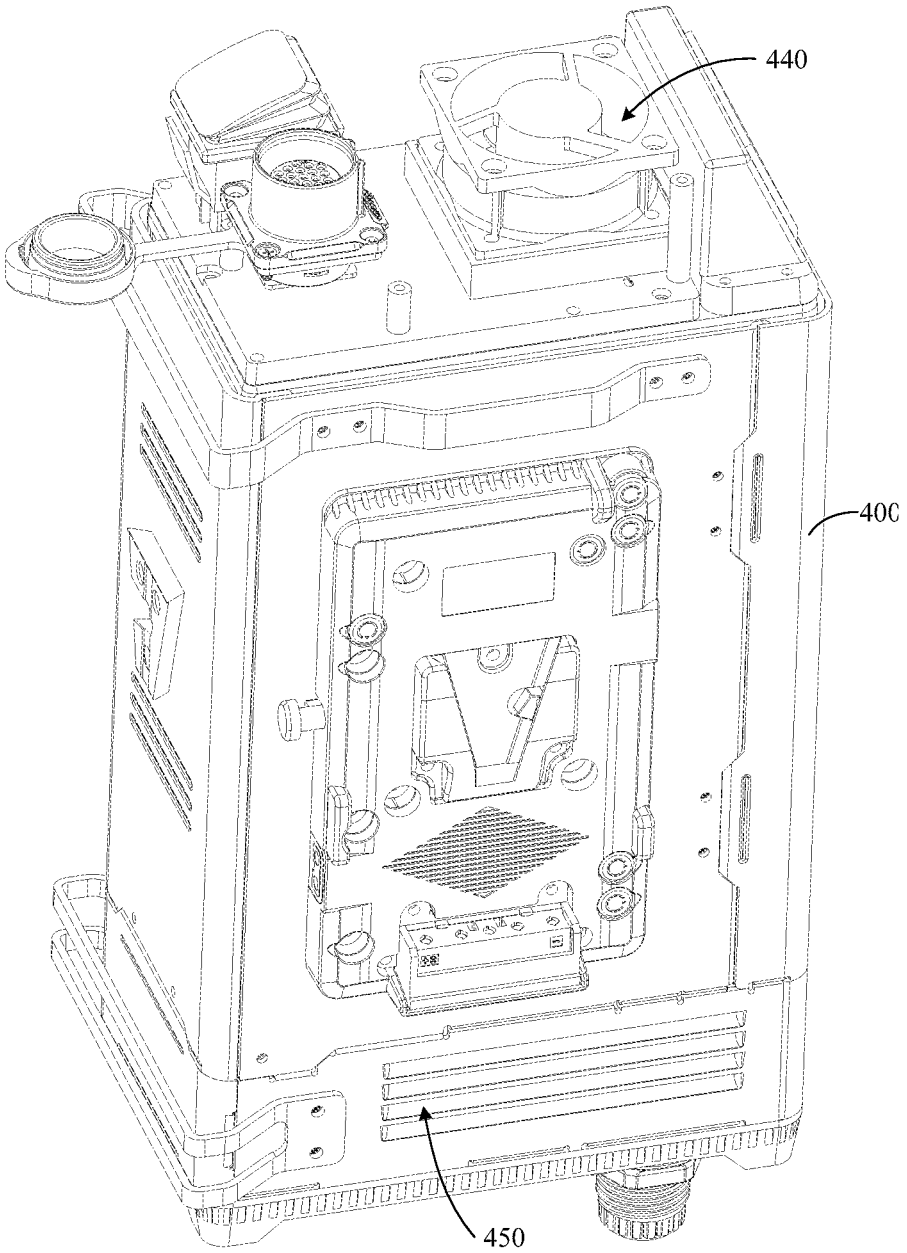
FIG. 25 is a schematic structural view of an electric control device of a spotlight according to an embodiment of the present disclosure.

Referring to FIG. 24, with regard to the sixteenth connecting line 196, the positive electrode G, the twenty-first bottom layer circuit unit H1-H2, and the connecting points G10 and G11 connected through the electrical connecting block thereof are the same as those in the above embodiment, which are not repeated herein. A connecting point H11 is provided on the bottom layer circuit 130 at the position corresponding to the connecting point G11, and the twenty-sixth bottom layer circuit unit H11-H12 is extended from the connecting point H11 towards the upper right to the connecting point H12. A connecting point G14 is provided on the top layer circuit 120 at the position corresponding to the connecting point H12, and the connecting point G14 is connected to a connecting point G15 through an electrical connecting block extending towards the right. The thirty-third top layer circuit unit G15-G16 is extended from the connecting point G15 towards the lower right to the connecting point G16. The thirty-third top layer circuit unit G15-G16 is located at the right side of the thirty-second top layer circuit unit G13-G5. The number of the lamp beads 300 connected to the thirty-third top layer circuit unit G15-G16 can be 15 to 19, taking 17 as an example. A connecting point H13 is provided on the bottom layer circuit 130 at the position corresponding to the connecting point G16, and the twenty-seventh bottom layer circuit unit H13-H14 is first extended upwards, then leftwards, and last upwards to the connecting point H14. A connecting point G17 is provided on the top layer circuit 120 at the position corresponding to the connecting point H14, the thirty-fourth top layer circuit unit G17-G18 is extended from the connecting point G17 towards the lower right to the connecting point G18, and the connecting point G18 is electrically connected to the upper right negative electrode H through the electrical connecting block. The thirty-fourth top layer circuit unit G17-G18 is located on the right side of the thirty-third top layer circuit unit G15-G16. The number of the lamp beads 300 connected to the thirty-fourth top layer circuit unit G17-G18 can be 3 to 7, taking 5 as an example. In some embodiments, in order to simplify the circuit, the electrical connecting block where the connecting point G18 is connected to the negative electrode H is partially overlapped with the electrical connecting block where the connecting point G5 is located. That is, the connecting point G5, the connecting point G18 and the negative electrode H are located on the same electrical connecting block.

The present disclosure further provides a spotlight, which comprises an outer housing and a light board. The specific structure of the light board refers to the above-mentioned embodiments. Since the spotlight adopts all the technical solutions of all the above-mentioned embodiments, so it has at least all the beneficial effects brought by the technical solutions of the above-mentioned embodiments, which will not be repeated here. The light board is installed on the outer housing.

In some embodiments, the spotlight comprises a light body and an electric control device, the light body is electrically connected with the electric control device, and the electric control device controls the operation of the light body.

The present disclosure provides the electric control device for the spotlight, which is used to supply electric power to the spotlight and control the spotlight, wherein the spotlight is used as supplement lighting sources during the photographing process.

In the embodiment of the present disclosure, as shown in FIG. 25 to FIG. 30, the electric control device for the spotlight comprises: an outer housing 400 which is provided with a first mounting chamber 410, an air cooling passage 430 and a second mounting chamber 420, wherein the air cooling passage 430 is located between the first mounting chamber 410 and the second mounting chamber 420, the first mounting chamber 410 and the air cooling passage 430 are separated by a first partition plate 510, and the second mounting chamber 420 and the air cooling passage 430 are separated by a second partition plate 520; the outer housing 400 is further provided with an air inlet 440 and an air outlet 450 communicating with the air cooling passage 430; a battery 530 installed within the first mounting chamber 410, and a main control board 550 installed within the second mounting chamber 420.

The outer housing 400 is used to form an overall appearance structure of the electric control device, the first mounting chamber 410, the air cooling passage 430 and the second mounting chamber 420 can be arranged along a lateral direction of the outer housing 400 or can be arranged along a longitudinal direction of the outer housing 400, which is not limited thereto, as long as the air cooling passage 430 is located between the first mounting chamber 410 and the second mounting chamber 420. For example, the air cooling passage 430 is extended along the longitudinal direction of the outer housing 400, in this case the air inlet 440 is formed at a top of the outer housing 400, and the air outlet 450 is formed at a bottom of the outer housing 400, so that a heat-radiating cycle with air inlet at the top and air outlet at the bottom is formed in the electric control device. The battery 530 is used for supplying electric power, and the main control board 550 is used for transmitting control signals. The heat generated by the battery 530 and the main control board 550 during operations will be transferred to the first partition plate 510 and the second partition plate 520 respectively, and the airflow flowing into the air cooling passage 430 will take away the heat of the first partition plate 510 and the second partition plate 520, so as to cool down the first partition plate 510 and the second partition plate 520.

Since the first mounting chamber 410 and the second mounting chamber 420 are separated from the air cooling passage 430 by the first partition plate 510 and the second partition plate 520, respectively, so that moisture or foreign objects entering into the air cooling passage 430 from the air inlet 440 or the air outlet 450 will not enter into the first mounting chamber 410 or the second mounting chamber 420, and will not cause damages to the battery 530 or the main control board 550, thus to improve the protection effects to the battery 530 and the main control board 550, thereby prolonging the service lives of the battery 530 and the main control board 550.

In the electric control device for the spotlight of the present disclosure, the air cooling passage 430 is separated from the battery 530 through the first partition plate 510, and the main control board 550 is separated from the air cooling passage 430 through the second partition plate 520, so that the moisture or the foreign objects entering into the air cooling passage 430 from the air inlet 440 or the air outlet 450 will not contact with the battery 530 and the main control board 550, therefore the battery 530 and the main control board 550 can be cooled down, and the battery 530 and the main control board 550 can be effectively protected as well, thus to prolong the overall service life of the electric control device of the spotlight.

Figure 26:
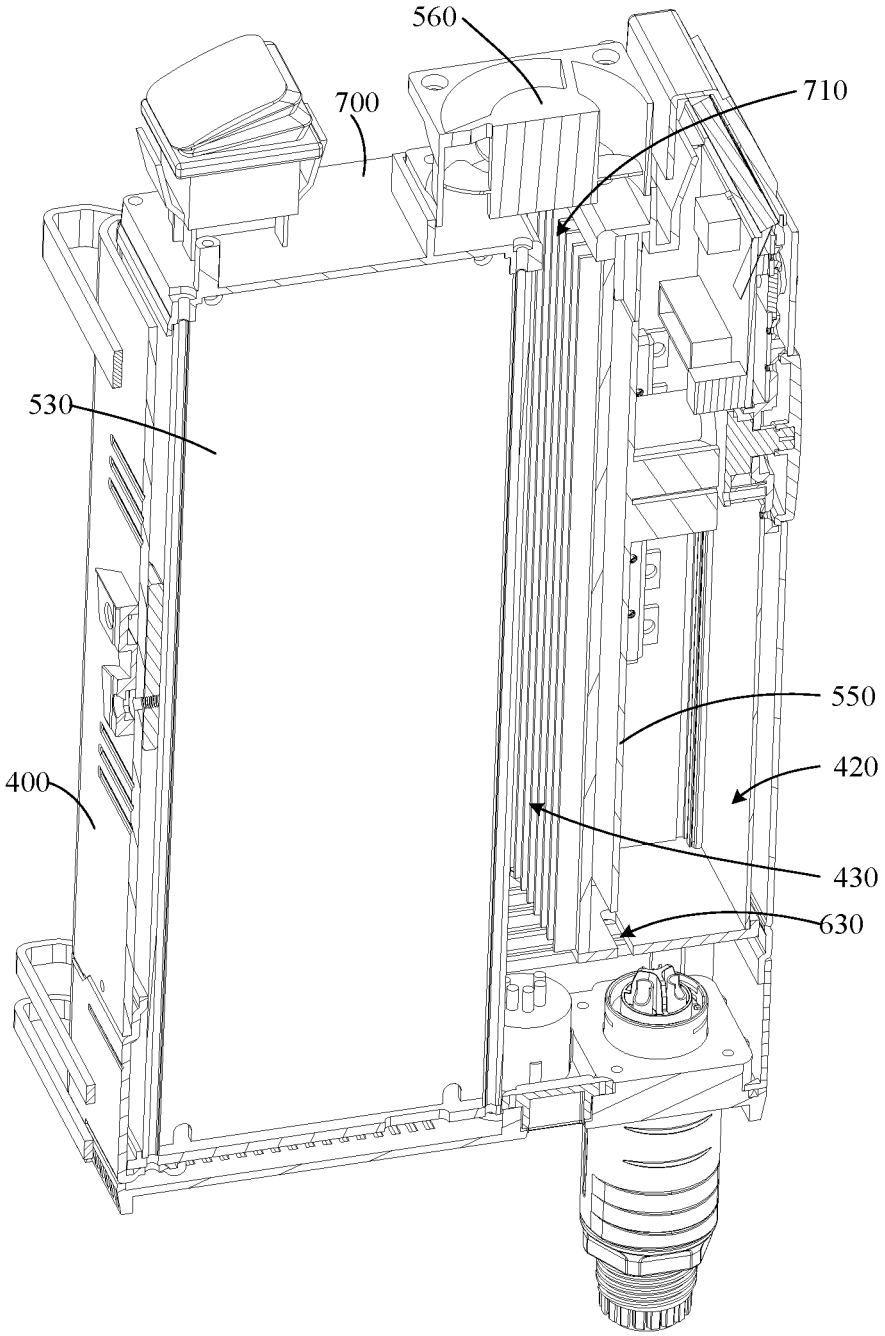
FIG. 26 is a longitudinal section view of the electric control device of the spotlight according to an embodiment of the present disclosure.
Figure 27:
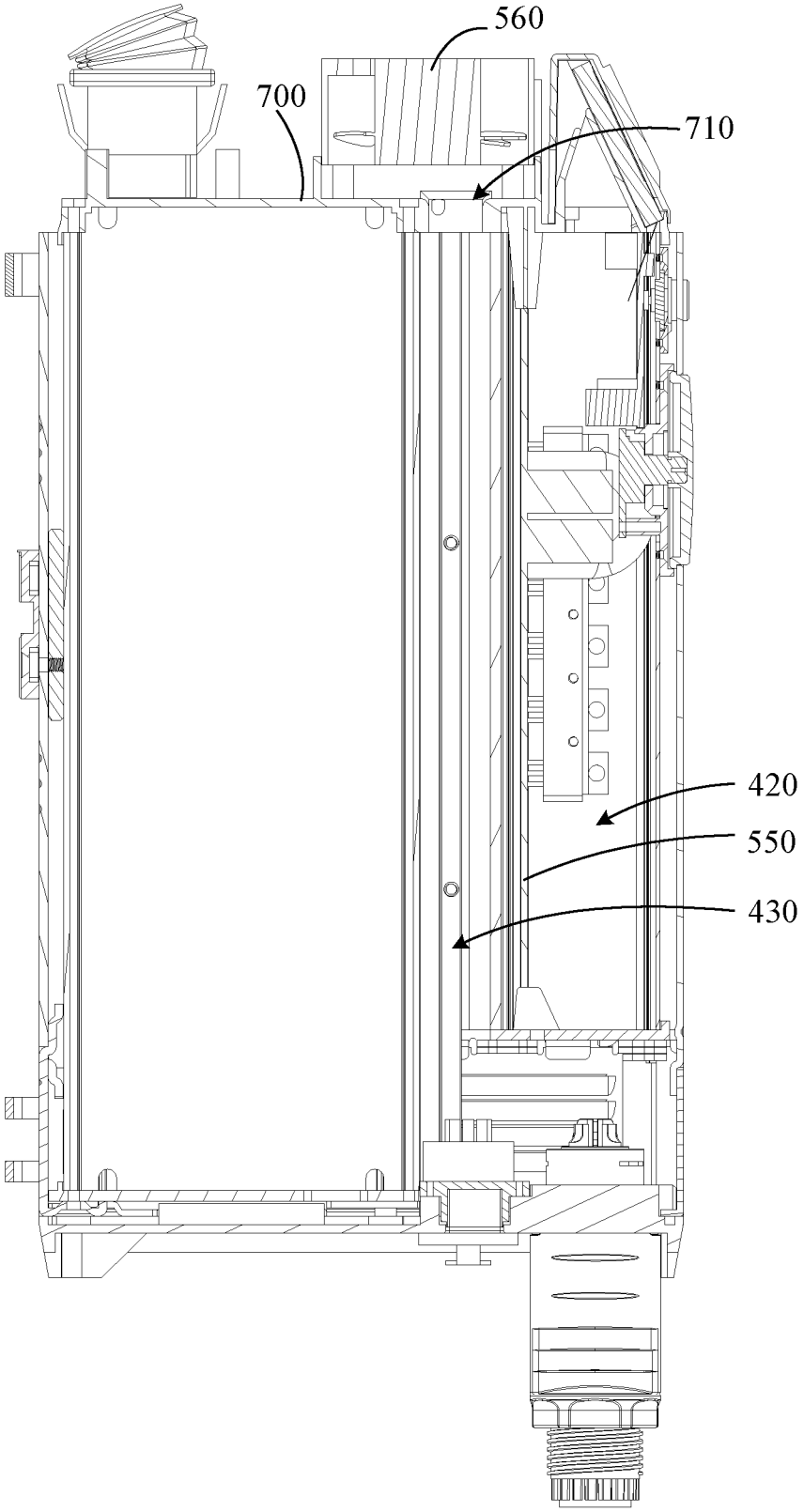
FIG. 27 is a longitudinal sectional view of the electric control device of the spotlight according to another embodiment of the present disclosure.
Figure 28:
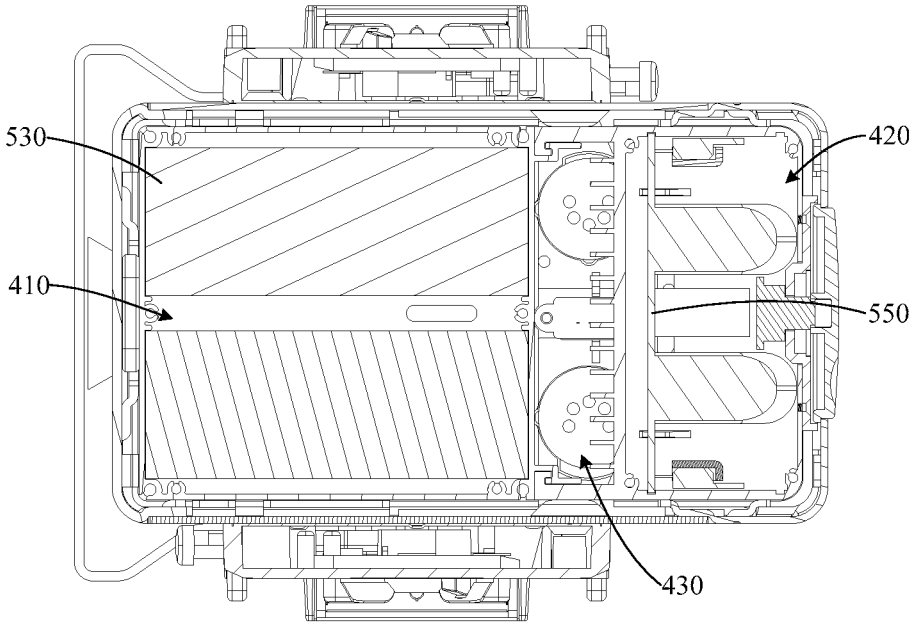
FIG. 28 is a horizontal section view of the electric control device of the spotlight according to other embodiment of the present disclosure.

In one embodiment, as shown in FIG. 26 and FIG. 27, the electric control device for the spotlight further comprises a heat-radiating rotor 560 arranged at the air inlet 440. The heat-radiating rotor 560 can be a cross-flow rotor or a centrifugal rotor, which is not limited herein. An air outlet side of the heat-radiating rotor 560 is faced to the air inlet 440 for driving the airflow from the air inlet 440 to the air outlet 450, so as to increase the flow speed of the airflow in the air cooling passage 430, thereby improving the heat-dissipating efficiency. It can be understood that the heat-radiating rotor 560 can also be arranged at the air outlet 450. In this case, an air inlet side of the heat-radiating rotor 560 is faced to the air outlet 450.

Figure 29:
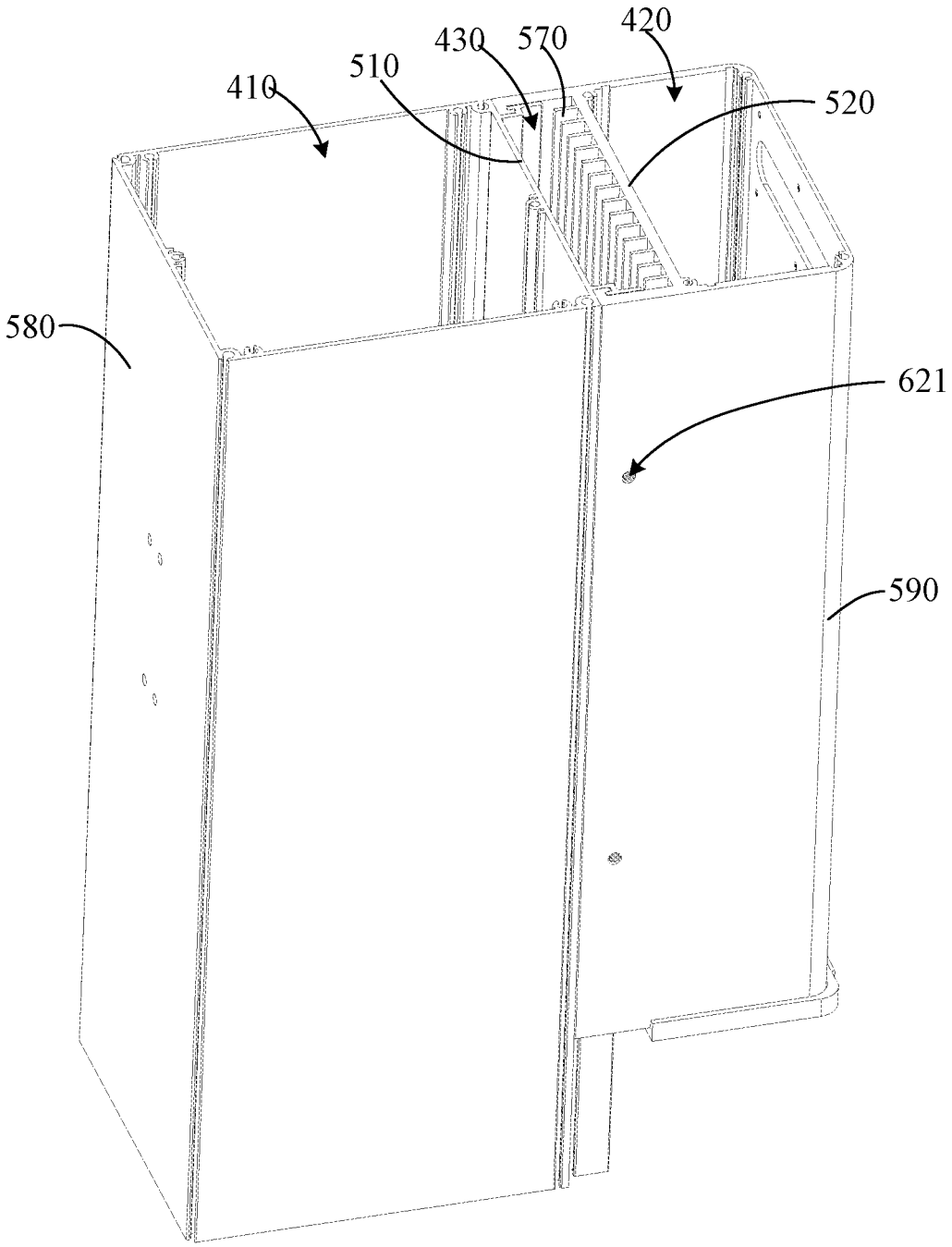
FIG. 29 is a schematic structural view of a first inner housing and a second inner housing according to an embodiment of the present disclosure.
Figure 30:
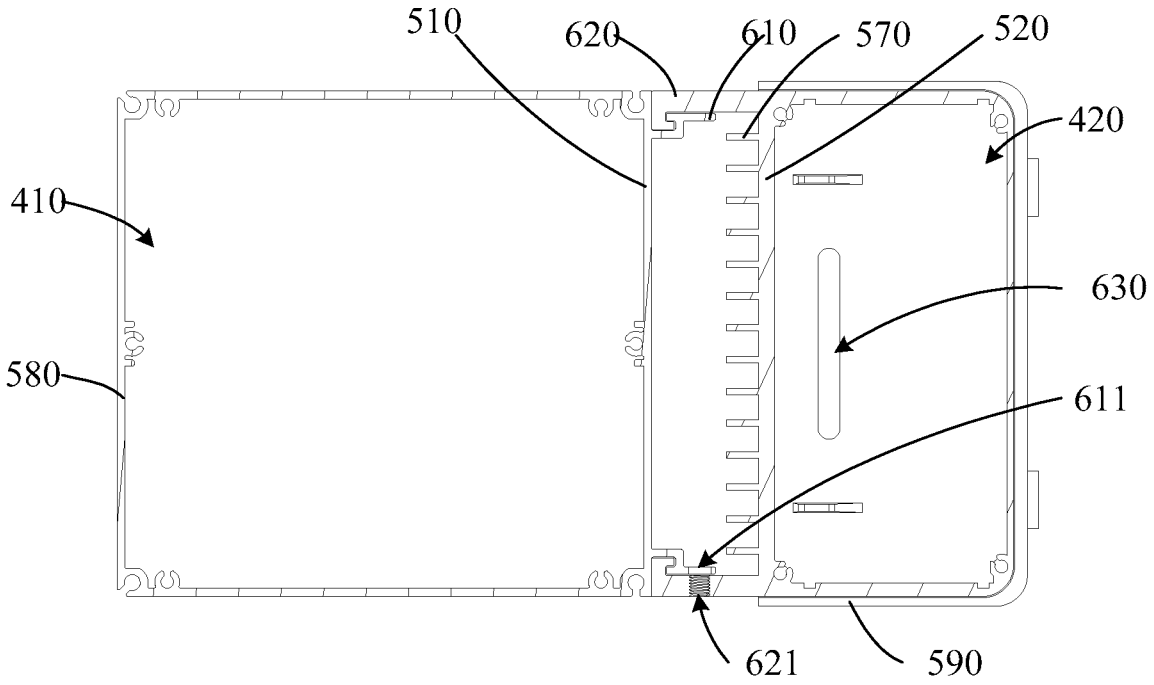
FIG. 30 is a horizontal section view of the first inner housing and the second inner housing according to an embodiment of the present disclosure.

Specifically, as shown in FIG. 29 and FIG. 30, the electric control device of the spotlight further comprises a heat-radiating structure 570 installed within the air cooling passage 430. The heat heat-radiating structure 570 can be a radiator installed independently within the air cooling passage 430, or can be an additional structure connected to the first partition plate 510 or the second partition plate 520, which is not limited herein. The heat-radiating structure 570 can absorb the heat transferred to the air cooling passage 430 and increase a contact area with the air, thereby further improving the heat-dissipating efficiency of the air cooling passage 430.

In practical application, as shown in FIG. 29 and FIG. 30, the heat-radiating structure 570 is configured as a heat-radiating rib, and the heat-radiating rib is connected to the second partition plate 520. The second partition plate 520 is located between the air cooling passage 430 and the second mounting chamber 420, the main control board 550 is installed within the second mounting chamber 420. The main control board 550 generates more heat during operation, that is, a temperature of the second partition plate 520 is higher than that of the first partition plate 510. Therefore, by connecting the heat-radiating rib to the second partition plate 520, the heat of the second partition plate 520 can be transferred to the heat-radiating rib more quickly, thus to improve the heat-dissipating efficiency. The heat-radiating rib can be extended along a length direction of the second partition plate 520, and the heat-radiating ribs are arranged at intervals along a width direction of the second partition plate 520, thus to increase sizes and quantities of the heat-radiating ribs, thereby further increasing the heat-dissipating area and improving the heat-dissipating efficiency.

In one embodiment, as shown in FIG. 29 and FIG. 30, the electric control device of the spotlight further comprises a first inner housing 580 and a second inner housing 590 that are arranged within the outer housing 400. The first inner housing 580 encloses the first mounting chamber 410, the second inner housing 590 encloses the second mounting chamber 420, and the air cooling passage 430 is located between the first inner housing 580 and the second inner housing 590. A housing plate of the first inner housing 580 adjacent to the air cooling passage 430 forms the first partition plate 510, and a housing plate of the second inner housing 590 adjacent to the air cooling passage 430 forms the second partition plate 520.

The first inner housing 580 and the second inner housing 590 may be fully enclosed shell-like structures or may be cylindrical structures with openings on end portions, which are not limited herein. The first inner housing 580 can separate the first mounting chamber 410 from the housing walls of the outer housing 400, so that the heat of the first mounting chamber 410 will not be directly transferred to the outer housing 400, thus to reduce the surface temperature of the outer housing 400 and improve the users' touch experiences. The second inner housing 590 can separate the second mounting chamber 420 from the housing walls of the outer housing 400, so that the heat of the first mounting chamber 410 will not be directly transferred to the outer housing 400, thus to reduce the surface temperature of the outer housing 400 and improve the users' touch experiences. The first inner housing 580 and the second inner housing 590 can be connected to each other or can be independent from each other, which is not limited herein, as long as the air cooling passage 430 is located between the first inner housing 580 and the second inner housing 590. The first inner housing 580 and the second inner housing 590 can also cooperate with the outer housing 400 to provide a double protection for the battery 530 and the main control board 550. When the electric control device is suffered from force, a buffering gap is formed between the first and second inner housing (580, 590) and the outer housing 400, thus to reduce the force transferred to the battery 530 and the main control board 550, thereby improving the protection effect to the battery 530 and the main control board 550.

Specifically, as shown in FIG. 29 and FIG. 30, a first connecting plate 610 is protruded from the first partition plate 510 towards the second partition plate 520, a second connecting plate 620 is protruded from the second partition plate 520 towards the first partition plate 510, and the first connecting plate 610 is connected with the second connecting plate 620. The first connecting plate 610 is connected to a vertical side of the first partition plate 510, and the second connecting plate 620 is connected to a vertical side of the second partition plate 520. The first connecting plate 610 is configured as connecting with the second connecting plate 620, so that a connection between the first inner housing 580 and the second inner housing 590 is achieved, the first inner housing 580 and the second inner housing 590 can support each other within the outer housing 400, thus an internal structure of the electric control device is more compact. The connection manner of the first connecting plate 610 and the second connecting plate 620 can be bonding or snap-on, which is not limited herein.

There are two first connecting plates 610, and both of them are respectively arranged on two vertical sides of the first partition plate 510, the quantities and positions of the second connecting plates 620 are corresponding to the first connecting plates 610, so that the air cooling passage 430 can be enclosed after the first connecting plate 610 and the second connecting plate 620 are connected, thus the heat of the air cooling passage 430 is firstly transferred to the first connecting plate 610 and the second connecting plate 620 but not directly transferred to the outer housing 400, thereby further decreasing the surface temperature of the outer housing 400 and improving the users' touch experiences.

Specifically, as shown in FIG. 29 and FIG. 30, a middle portion of the first connecting plate 610 is bent to form a buckling groove, an end of the second connecting plate 620 is bent to form a hook groove, the hook groove and the buckling groove are engaged with each other. It can be understood that the middle portion of the first connecting plate 610 refers to a middle portion extending from the first partition plate 510 to the second partition plate 520, and the end of the second connecting plate 620 is an end away from the second partition plate 520. The buckling groove of the first connecting plate 610 is mutually engaged with the hooking groove of the second connecting plate 620, so that a mating area of the first connecting plate 610 and the second connecting plate 620 is increased, thus to improve the mating stability and strength.

In practical application, as shown in FIG. 29 and FIG. 30, an end of the first connecting plate 610 is lapped with the second connecting plate 620. The first connecting plate 610 is provided with a through-hole 611, the second connecting plate 620 is provided with a fixing hole 621 corresponding to the through-hole 611, and the through-hole 611 and the fixing hole 621 can be connected through a fastener. By connecting the through-hole 611 of the first connecting plate 610 and the fixing hole 621 of the second connecting plate 620 through the fastener, the first connecting plate 610 is more tightly connected with the second connecting plate 620 to avoid shaking. The fixing hole 621 can be configured as a threaded hole, and the fastener can be configured as a screw, the fitting process of the fastener and fixing hole 621 is simplified, thus the assembling efficiency has been improved.

In one embodiment, as shown in FIG. 26 and FIG. 30, a heat-radiating hole 630 is formed at a bottom of the second inner housing 590, and the heat-radiating hole 630 is communicated with the air cooling passage 430. The heat-radiating hole 630 communicates the second mounting chamber 420 with the air cooling passage 430, so that the hot air in the second mounting chamber 420 can enter the air cooling passage 430 through the heat-radiating hole 630, thus to improve the heat-dissipating efficiency of the second mounting chamber 420. The heat-radiating hole 630 is formed at the bottom of the second inner housing 590, so even if the foreign objects enter into the air cooling passage 430, it will not easily enter into the second mounting chamber 420 from the heat-radiating hole 630 due to the action of gravity, thus the main control board 550 can be effectively protected.

Specifically, as shown in FIG. 26 and FIG. 27, the electric control device of the spotlight further comprises an inner top cover 700. Openings are formed on top of both the first inner housing 580 and the second inner housing 590, and the inner top cover 700 is covered on the top of both the first inner housing 580 and the second inner housing 590. The inner top cover 700 is provided with an air-passing hole 710, and the air-passing hole 710 communicates the air inlet 440 with the air cooling passage 430.

During the assembly of the battery 530 and the main control board 550, the battery 530 and the main control board 550 can be respectively installed into the first mounting chamber 410 and the second mounting chamber 420 from the top openings of the first inner housing 580 and the second inner housing 590, and the inner top cover 700 is covered both on the top opening of the first inner housing 580 and the second inner housing 590 to achieve an indirect connection between the first inner housing 580 and the second inner housing 590, so that the connection structure between the first inner housing 580 and the second inner housing 590 is more stable. It can be understood that the inner top cover 700 covers on the air cooling passage 430 while covering the first inner housing 580 and the second inner housing 590, thus the air-passing hole 710 is provided for communicating the air inlet 440 with the air cooling passage 430. The heat-radiating rotor 560 can be installed on the top of the inner top cover 700. The electric control device can further comprises an outer top cover, which is covered on the heat-radiating rotor 560 and the inner top cover 700, so as to protect the heat-radiating rotor 560 and the inner top cover 700.

The above description is only the preferred embodiments of the present disclosure and does not limit the protection scope of the present disclosure, any equivalent structures or equivalent process modifications used based on the contents of the specification and accompanying drawings in the present disclosure, no matter whether it is directly or indirectly used in any other related technical field, should be included within the protection scope of the present invention.

What is claimed is:

1. A spotlight comprising a light body and an electric control device, wherein the light body comprises a light board, the light board comprises a circuit board and lamp beads;

wherein the circuit board defines mounting positions, the lamp beads are mounted in the mounting positions and comprise cool color lamp beads and warm color lamp beads, the cool color lamp beads and the warm color lamp beads are configured to form lamp bead rows, and the lamp bead rows are arranged along a first direction;

wherein each lamp bead row comprises both the cool color lamp beads and the warm color lamp beads, a difference between the number of the cool color lamp beads and the number of the warm color lamp beads does not exceed 2, a difference between a total number of the cool color lamp beads and a total number of the warm color lamp beads in two adjacent lamp bead rows does not exceed 3, and a total number of all the cool color lamp beads on the circuit board is equal to a total number of the warm color lamp beads;

the electric control device comprises an outer housing, a battery, and a main control board;

wherein the outer housing defines a first mounting chamber, an air cooling passage, and a second mounting chamber; the air cooling passage is located between the first mounting chamber and the second mounting chamber; the first mounting chamber and the air cooling passage are separated by a first partition plate; the second mounting chamber and the air cooling passage are separated by a second partition plate; the outer housing further defines an air inlet and an air outlet communicated with the air cooling passage; the battery is arranged within the first mounting chamber; the main control board is arranged within the second mounting chamber.

2. The spotlight according to claim 1, wherein the electric control device further comprises a first inner housing and a second inner housing that are arranged within the outer housing, the first inner housing encloses the first mounting chamber, the second inner housing encloses the second mounting chamber, and the air cooling passage is located between the first inner housing and the second inner housing, and wherein a housing plate of the first inner housing adjacent to the air cooling passage forms the first partition plate, and a housing plate of the second inner housing adjacent to the air cooling passage forms the second partition plate.

3. The spotlight according to claim 2, wherein a first connecting plate is protruded from the first partition plate towards the second partition plate, a second connecting plate is protruded from the second partition plate towards the first partition plate, and the first connecting plate is connected with the second connecting plate.

* * * * *